US012644217B2

(12) United States Patent
Cho et al.

(10) Patent No.: US 12,644,217 B2
(45) Date of Patent: Jun. 2, 2026

(54) CLOTHING TREATMENT DEVICE AND CONTROL METHOD THEREFOR

(71) Applicant: LG ELECTRONICS INC., Seoul (KR)

(72) Inventors: Young Han Cho, Seoul (KR); Sun Cheol Bae, Seoul (KR); Jung Hun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 158 days.

(21) Appl. No.: 18/686,503

(22) PCT Filed: Jul. 27, 2022

(86) PCT No.: PCT/KR2022/011041

§ 371 (c)(1),
(2) Date: Feb. 26, 2024

(87) PCT Pub. No.: WO2023/033368

PCT Pub. Date: Mar. 9, 2023

(65) Prior Publication Data

US 2024/0352639 A1 Oct. 24, 2024

(30) Foreign Application Priority Data

Aug. 30, 2021 (KR) ..... 10-2021-0115090

(51) Int. Cl.
*D06F 33/42* (2020.01)
*D06F 33/34* (2020.01)
(Continued)

(52) U.S. Cl.
CPC ..... *D06F 34/18* (2020.02); *D06F 33/34* (2020.02); *D06F 33/42* (2020.02); *D06F 2103/04* (2020.02); *D06F 2103/26* (2020.02)

(58) Field of Classification Search
CPC ..... D06F 34/16; D06F 34/18; D06F 34/34; D06F 34/40; D06F 34/42; D06F 34/48;
(Continued)

(56) References Cited

U.S. PATENT DOCUMENTS 6,023,854 A * 2/2000 Tsunomoto ..... D06F 33/48 34/560
2003/0056300 A1* 3/2003 Ruhl ..... D06F 33/42 68/12.02

(Continued)

FOREIGN PATENT DOCUMENTS

EP 3 051 017 B1 9/2019
KR 10-0175631 B1 5/1999

(Continued)

OTHER PUBLICATIONS

Machine Translation of KR 10-1455773, Nov. 2014. (Year: 2014).*

*Primary Examiner* — David G Cormier
(74) *Attorney, Agent, or Firm* — Birch, Stewart, Kolasch & Birch, LLP

(57) ABSTRACT

A control method of a clothing treatment device including a cabinet forming an exterior, a tub provided in the cabinet and configured to store water, a drum provided to the tub in a rotatable manner and configured to receive clothing, a drainage unit configured to drain water from the tub, and a driving unit configured to rotate the drum is provided that includes a clothing amount sensing operation of sensing a weight of clothing, a water supply operation of supplying water to the tub a first dehydration operation of maintaining at least a portion of the supplied water and rotating the drum while drainage is stopped, and a second dehydration operation of rotating the drum at a drum rotation speed higher than a maximum drum rotation speed in the first dehydration
(Continued)

operation, and the drainage is performed in at least a portion of periods after the first dehydration operation.

16 Claims, 14 Drawing Sheets

(51) Int. Cl.
*D06F 34/18* (2020.01)
*D06F 103/04* (2020.01)
*D06F 103/26* (2020.01)

(58) Field of Classification Search
CPC ..... D06F 37/22; D06F 37/225; D06F 37/24; D06F 37/245; D06F 2103/04; D06F 2103/24; D06F 2103/26; D06F 2105/08; D06F 2105/46; D06F 33/34; D06F 33/40; D06F 33/42; D06F 33/48
See application file for complete search history.

(56) References Cited

U.S. PATENT DOCUMENTS

| | | | | |
|---|---|---|---|---|
| 2011/0016638 | A1 | 1/2011 | Kim | |
| 2014/0310884 | A1 | 10/2014 | Kwon et al. | |
| 2016/0222569 | A1* | 8/2016 | Kim | D06F 29/02 |
| 2017/0073873 | A1 | 3/2017 | Choi | |

FOREIGN PATENT DOCUMENTS

| | | | |
|---|---|---|---|
| KR | 10-2007-0095608 | A | 10/2007 |
| KR | 10-2010-0006028 | A | 1/2010 |
| KR | 10-2011-0009923 | A | 1/2011 |
| KR | 10-2014-0124560 | A | 10/2014 |
| KR | 10-1455773 | B1 | 11/2014 |
| KR | 10-1624532 | B1 | 5/2016 |
| KR | 10-1757434 | B1 | 7/2017 |
| KR | 10-2018-0099588 | A | 9/2018 |
| KR | 10-2020-0009831 | A | 1/2020 |

* cited by examiner

FIG. 11

1100

| | Clothing amount LV | Information on recent three times of dehydration with remaining water | | | | | | | |
|---|---|---|---|---|---|---|---|---|---|
| | | N-2 | | N-1 | | N | | Evolution variable ΔA | Evolution variable ΔB |
| | | Tub vibration (mm) | IPM temperature (°C) | Tub vibration (mm) | IPM temperature (°C) | Tub vibration (mm) | IPM temperature (°C) | amount to add water (ℓ) | time point of drainage (RPM) |
| | | | | | | | | | |
| 1105 | 1 | 1 | 67 | 2 | 62 | 1 | 71 | 0 | 20 |
| | ... | | | | | | | | |
| 1110 | 5 | 5 | 72 | 7 | 69 | 9 | 74 | 2 | 0 |
| 1115 | 6 | 10 | 88 | 11 | 90 | 10 | 85 | 5 | -30 |
| | | | | | | | | | |

CLOTHING TREATMENT DEVICE AND CONTROL METHOD THEREFOR

CROSS REFERENCE TO RELATED APPLICATIONS

This application is the National Phase of PCT International Application No. PCT/KR2022/011041, filed on Jul. 27, 2022, which claims priority under 35 U.S.C. 119 (a) to Patent Application No. 10-2021-0115090, filed in the Republic of Korea on Aug. 30, 2021, all of which are hereby expressly incorporated by reference into the present application.

TECHNICAL FIELD

Example embodiments of the present disclosure relate to a clothing treatment device and a control method therefor. Specifically, example embodiments of the present disclosure relate to a control method for reducing vibration at a time of a dehydration stroke and a clothing treatment device using the control method.

BACKGROUND ART

Generally, a clothing treatment device is a device that may perform washing, drying, or the washing with the drying of clothing or the like. Here, the clothing treatment device may perform only a function of the washing or the drying, or all of the washing and the drying. In addition, a washing machine including a steam supply device to include a refresh function such as wrinkle removal, odor removal, static electricity removal, or the like of the clothing is currently distributed.

Meanwhile, clothing treatment devices of related arts are classified into a front-load type or a top-load type depending on a direction of taking out clothing. A representative example of such a horizontal type is a drum washing machine or a drum dryer.

A front-load type clothing treatment device is a clothing treatment device including an opening part in a front and including a rotating shaft of a drum in a direction parallel to a ground surface or with a predetermined inclination. A top-load type clothing treatment device is a clothing treatment device including an opening part in an upper part and including a rotating shaft of a drum vertically to the ground surface.

Generally, each household has and uses one large-capacity clothing treatment device. Thus, when laundry is separated according to a type and is to be washed, the clothing treatment device is used multiple times. For example, when laundry such as adult clothing and laundry such as underwear and baby clothes are separated to be washed, the clothing treatment device is used again to wash the latter one after washing the former one is completed. Accordingly, a time of washing is greatly taken, and energy is also greatly consumed.

In addition, using such a large clothing treatment device of related arts in order to wash a small amount of clothing is not desirable in terms of saving energy. Since a washing course offered in the large clothing treatment device is mostly supposed to have a large amount of laundry, a large amount of water is consumed. Also, a large amount of power is consumed to rotate a large drum.

Furthermore, the time of washing is relatively long because the washing course is supposed to have the large amount of laundry.

Also, since the large-sized clothing treatment device is mainly supposed to have ordinary clothing and include the washing course accordingly, the large-sized clothing treatment device may be unsuitable for washing delicate clothes such as the underwear or the baby clothes.

In addition, the large-sized clothing treatment device is unsuitable even for frequently washing a small amount of laundry. Consumers collect laundry over periods of several days or more in order to wash the collected laundry at one time. Leaving the underwear, the baby clothes, or the like unattended for a long time is improper in terms of cleanliness. Also, there is a problem that such laundry is not cleanly washed due to adhesion of dirt when the laundry is left unattended for a long time.

Thus, a small-sized clothing treatment device having a capacity smaller than that of the large-sized clothing treatment device of related arts is required.

However, although the clothing treatment device is small, providing and installing side by side two clothing treatment devices in one household is not desirable for use of a space and improper for a fine view.

Recently, a clothing treatment device in which the small-sized clothing treatment device and the large-sized clothing treatment device may be coupled to be one has been introduced in order to solve the above-described matter.

Small clothing treatment devices may have been coupled to at least one of an upper part, a lower part, or a side surface of a main clothing treatment device so as to be provided thereto or may be provided separately from the main clothing treatment device.

It has been possible to save the energy and the use of the space because of introduction of the small clothing treatment device.

However, since the small clothing treatment device is generally used as an auxiliary clothing treatment device, the small clothing treatment device has a limited volume. In order to improve this, in a drum of the small clothing treatment device, a diameter corresponding to an introduction port and a floor surface may be provided to be wider than a height or a length of one surface adjacent to the introduction port and the floor surface, and the small clothing treatment device which includes the drum may maximally secure a washing capacity. However, when a dehydration stroke of removing water from the clothing by rotating the drum at a high speed is performed, vibration occurs because the diameter of the drum is long and a rotation speed becomes faster. As a result, the clothing treatment device has had a matter of being shaken and changing a position thereof, and a malfunction has occurred therein.

In order to prevent such vibration, Korean Patent No. 1757434 discloses, so as to reducing the vibration, dampers that are provided to an outer shell and an inner shell and use a magnetic field to reduce the vibration. However, there has been a matter that easiness of assembling is decreased when an additional device is provided as such, and a matter that it is difficult to effectively respond to various use environments of the clothing treatment device by reducing the vibration with a constant mechanism regardless of a change of laundry.

DETAILED DESCRIPTION OF THE INVENTION

Technical Goals

Example embodiments of the present disclosure are to provide a clothing treatment device and a control method thereof for preventing excessive vibration due to resonance.

Example embodiments of the present disclosure are to provide a clothing treatment device and a control method thereof for preventing excessive vibration by performing rotation with leaving water without drainage at a time of initial rotation in a dehydration stroke, and for reducing vibration and simultaneously preventing a malfunction due to an excessive load by determining timing of the drainage depending on a load for the rotation.

Example embodiments of the present disclosure are to provide a clothing treatment device and a control method thereof for performing dehydration with remaining water for reducing vibration when vibration occurrence possibility may be high through sensing fabric texture, determining timing to perform drainage depending on rotation revolutions per minute (RPM) for the dehydration, and then maximizing dehydration performance while the vibration is reduced by adjusting a maximum RPM depending on an amount of the vibration.

Example embodiments of the present disclosure are to provide a clothing treatment device and a control method thereof for performing vibration reduction and excessive load prevention to which an installation environment is applied by adaptively determining an amount of remaining water and drainage timing through an existing operation history according to the installation environment when a dehydration stroke is performed.

Example embodiments of the present disclosure are to provide a clothing treatment device and a control method thereof for reducing occurrence of vibration at a time of a dehydration stroke and reducing a malfunction due to a load by adaptively adjusting an amount of remaining water at a time of dehydration, drainage RPM, and maximum RPM based on a temperature of a power module of a driving unit associated with drum rotation when the dehydration is performed.

Technical Solutions

According to an aspect, there is provided a control method of a clothing treatment device including a cabinet forming an exterior, a tub provided in the cabinet and configured to store water, a drum provided to the tub in a rotatable manner and configured to receive clothing, a drainage unit configured to drain water from the tub, and a driving unit configured to rotate the drum, the control method including a clothing amount sensing operation of sensing a weight of clothing, a water supply operation of supplying water to the tub, a first dehydration operation of maintaining at least a portion of the supplied water and rotating the drum while drainage is stopped, and a second dehydration operation of rotating the drum at a drum rotation speed higher than a maximum drum rotation speed in the first dehydration operation, and the drainage is performed in at least a portion of periods after the first dehydration operation.

According to another aspect, there is also provided a clothing treatment device including a cabinet forming an exterior, a tub provided in the cabinet and configured to store water, a drum provided to the tub in a rotatable manner and configured to receive clothing, a drainage unit configured to drain water from the tub, a driving unit configured to rotate the drum, and a controller configured to control the clothing treatment device to perform a clothing amount sensing operation of sensing a weight of clothing, a water supply operation of supplying water to the tub, a first dehydration operation of maintaining at least a portion of the supplied water and rotating the drum while drainage is stopped, and a second dehydration operation of rotating the drum at a drum rotation speed higher than a maximum drum rotation speed in the first dehydration operation, and the drainage is performed in at least a portion of periods after the first dehydration operation.

Effects of the Invention

According to example embodiments of the present disclosure, it is possible to reduce vibration at a time of a dehydration stroke without an additional mechanical structure for vibration reduction and reduce a malfunction by adjusting a load of a clothing treatment device.

According to example embodiments of the present disclosure, it is possible to optimize, by adaptively adjust RPM to start dehydration and maximum RPM by determining fabric texture and a degree of the load of the clothing treatment device, vibration reduction and load management in an environment in which the clothing treatment device is operated.

BRIEF DESCRIPTION OF DRAWINGS

FIG. 11 is a diagram illustrating a method of setting an evolution variable depending on dehydration with remaining water according to a recent operation value according to example embodiments of the present disclosure.

MODE FOR CARRYING OUT THE INVENTION

Figure 1A:
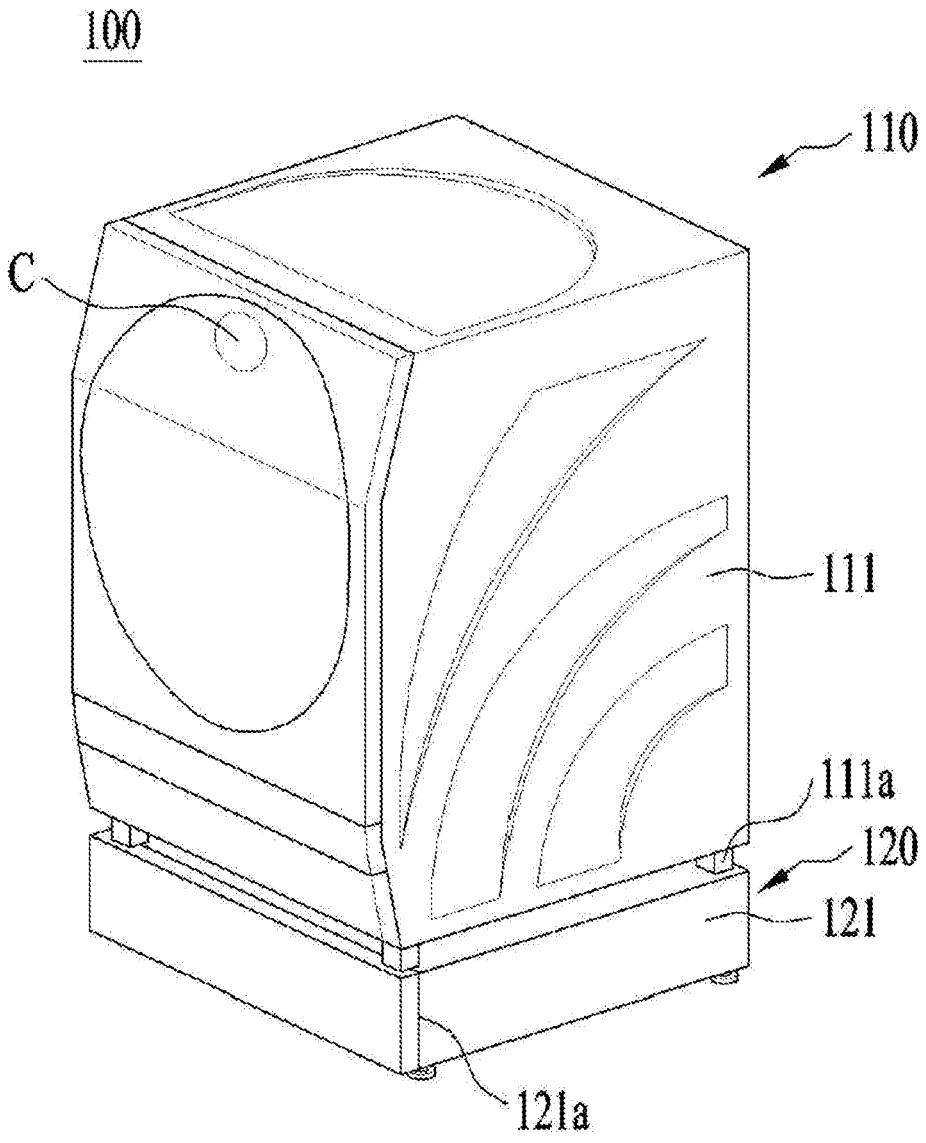
FIGS. 1A through 1C illustrate a clothing treatment device of example embodiments of the present disclosure.

Hereinafter, example embodiments of the present disclosure will be described with reference to the drawings.

In describing the example embodiments, descriptions of technical contents that are well known in the art to which the present disclosure belongs and are not directly related to the present specification will be omitted. This is to more clearly communicate without obscuring the subject matter of the present specification by omitting unnecessary descriptions.

For the same reason, in the accompanying drawings, some components are exaggerated, omitted or schematically illustrated. In addition, the size of each component does not fully reflect the actual size. The same or corresponding components in each drawing are given the same reference numerals.

Advantages and features of the present disclosure and methods of achieving them will be apparent from the following example embodiments that will be described in more detail with reference to the accompanying drawings. It should be noted, however, that the present disclosure is not limited to the following example embodiments, and may be implemented in various forms. Accordingly, the example embodiments are provided only to disclose the present disclosure and let those skilled in the art know the category of the present disclosure. The present disclosure is merely defined by a category of the claims. The same reference numerals or the same reference designators denote the same elements throughout the specification.

At this point, it will be understood that each block of the flowchart illustrations and combinations of flowchart illustrations may be performed by computer program instructions. Since these computer program instructions may be mounted on a processor of a general purpose computer, special purpose computer, or other programmable data processing equipment, those instructions executed through the computer or the processor of other programmable data processing equipment may create a means to perform the functions be described in flowchart block(s). These computer program instructions may be stored in a computer usable or computer readable memory that can be directed to a computer or other programmable data processing equipment to implement functionality in a particular manner. Thus, it is also possible for the instructions stored in the computer usable or computer readable memory to produce an article of manufacture containing instruction means for performing the functions described in the flowchart block(s). The Computer program instructions may also be mounted on a computer or other programmable data processing equipment, such that a series of operating steps may be performed on the computer or other programmable data processing equipment to create a computer-implemented process. Accordingly, the instructions for performing the processing equipment may also provide steps for performing the functions described in the flowchart block(s).

In addition, each block may represent a portion of a module, segment, or code that includes one or more executable instructions for executing a specified logical function (s). It should also be noted that in some alternative implementations, the functions noted in the blocks may occur out of order. For example, the two blocks shown in succession may in fact be executed substantially concurrently, or the blocks may sometimes be executed in the reverse order, depending on the corresponding function.

At this point, a term "part" in the example embodiments performs a certain role and refers to a software component or a hardware component such as a field-programmable gate array (FPGA) or an application-specific integrated circuit (ASIC). However, a part is not limited to software or hardware. The part may be in a storage medium that may perform addressing, or operate one or more processors. Thus, for example, the part includes components such as software components, object-oriented software components, class components, and task components, processes, functions, attributes, procedures, subroutines, segments of program code, drivers, firmware, microcode, circuits, data, databases, data structures, tables, arrays, and variables. Functions provided in the components and the parts may be combined in the fewer components and the fewer parts or separated in the additional components and the additional parts. In addition, the components and the parts may be realized to operate a device or one or more central processing units (CPU) in a security multimedia card.

Figure 1B:
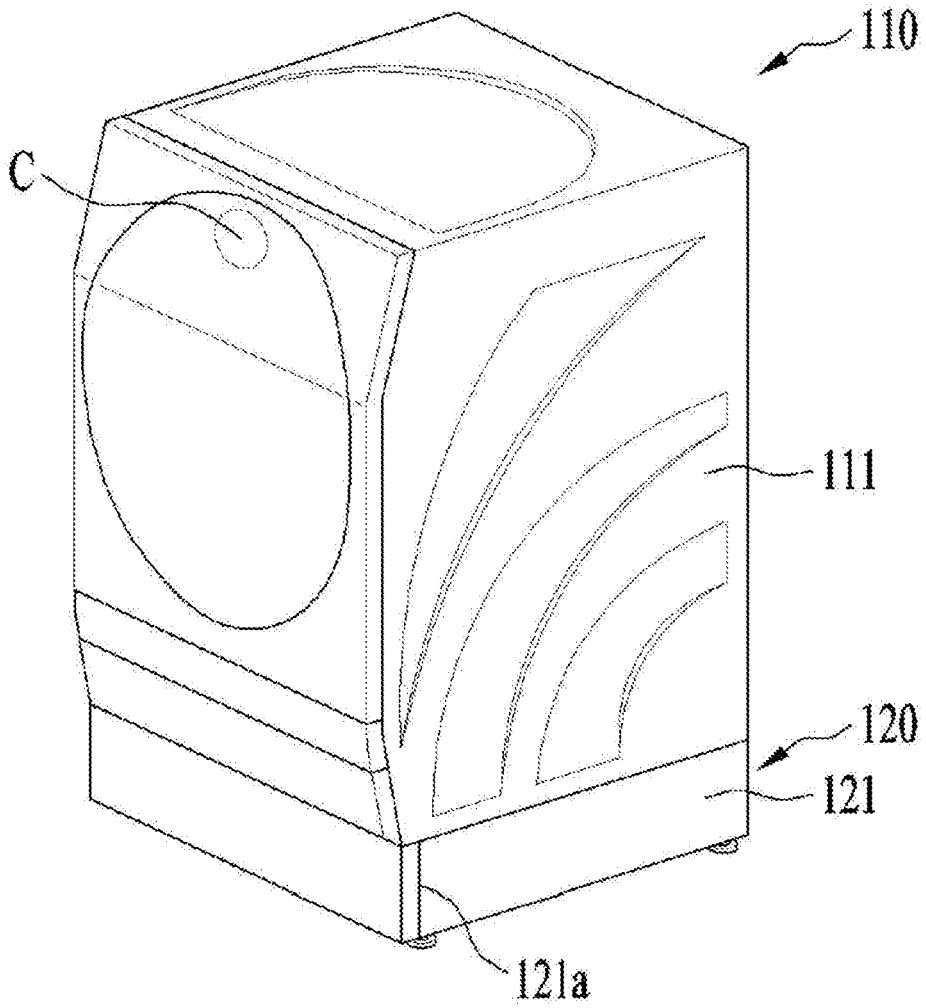
Figure 1C:
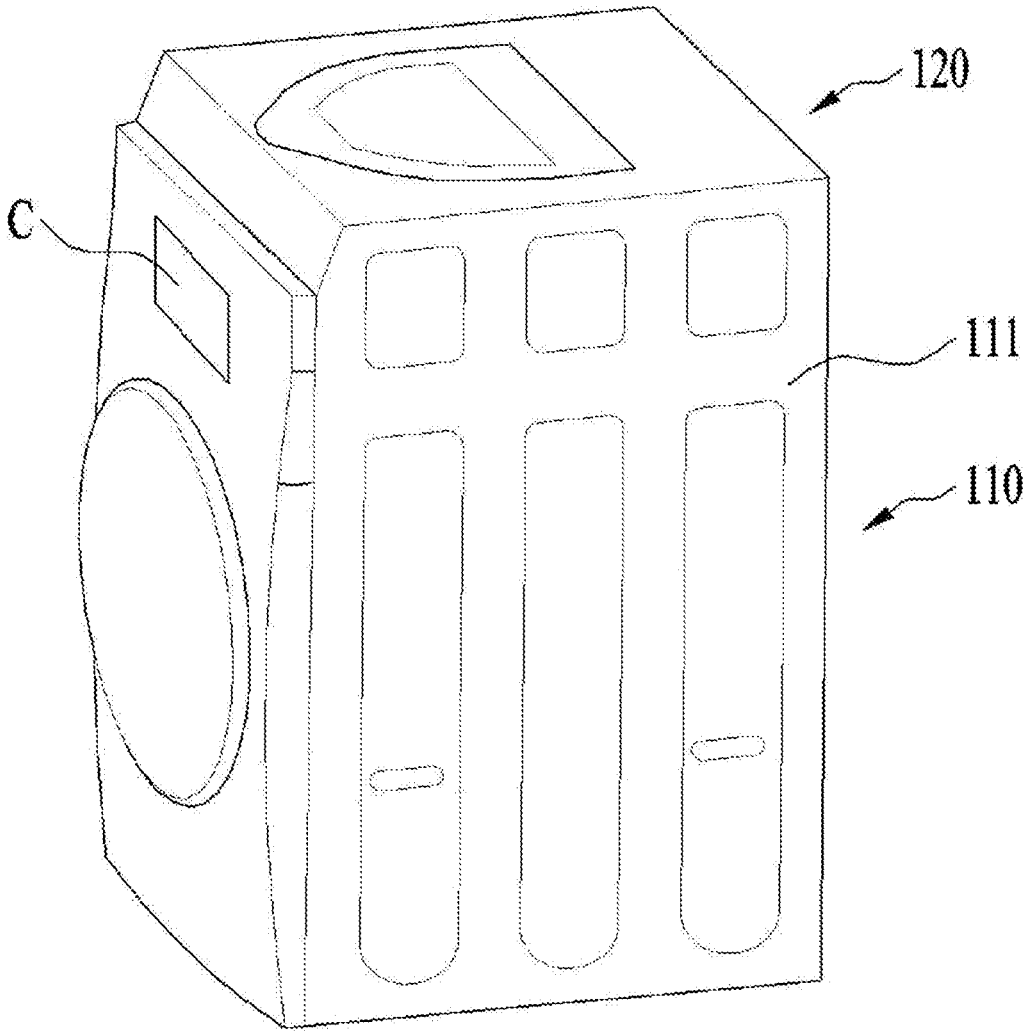

FIGS. 1A through 1C illustrate a clothing treatment device of example embodiments of the present disclosure. Referring to FIGS. 1A through 1C, an exterior of the clothing treatment device according to example embodiments of the present disclosure is illustrated.

The clothing treatment device according to example embodiments of the present disclosure may include a first processing unit 110 that is a main clothing treatment device and a second processing unit 120 that is an auxiliary clothing treatment device. The first processing unit 110 and the second processing unit 120 may not be coupled and combined to be provided in the clothing treatment device of the present disclosure as well. That is, the clothing treatment device of the present disclosure may include only the first processing unit 110 or only the second processing unit 120.

Descriptions based on that a plurality of processing units is provided in the clothing treatment device of the present disclosure are merely for convenience, not excluding that the clothing treatment device of the present disclosure includes one processing unit.

The first processing unit 110 may be provided as a washing device that performs a washing stroke for removing a foreign substance or as a drying device that performs a drying stroke for drying clothing containing water. Even when the first processing unit 110 is provided as the washing device, the first processing unit 110 may perform the drying stroke for drying the clothing.

The second processing unit 120 may be also provided as the washing device that performs the washing stroke for removing the foreign substance or as the drying device that performs the drying stroke for drying the clothing containing water. Even when the second processing unit 120 is provided as the washing device, the second processing unit 120 may perform the drying stroke.

The first processing unit 110 may be provided in a size larger than that of the second processing unit 120 so as to have a washing or drying capacity larger than that of the second processing unit 120.

This is for allowing the second processing unit 120 to rapidly wash or dry underwear, baby clothes, a small amount of clothing, or the like while saving energy.

The second processing unit 120 may be separated from the first processing unit 110 and provided in combination with the first processing unit 110 (referring to FIGS. 1A and 1B) or may be provided integrally with the first processing unit 110 (referring to FIGS. 1B and 1C).

Referring to FIG. 1A, the second processing unit 120 may be provided separately from the first processing unit 110, and the second processing unit 120 may be coupled to the first processing unit 110 to form one clothing treatment device.

When the second processing unit 120 is provided separately from the first processing unit 110, the first processing unit 110 may include a first cabinet 111 forming the exterior, and the second processing unit 120 may include a second cabinet 121 forming the exterior and provided separately from the first cabinet 111.

The second processing unit 120 may be provided to a lower part of the first processing unit 110.

In addition, even if provided separately from the first processing unit 110, the second processing unit 120 may be provided to at least one of an upper part, the lower part, and a side surface of the first processing unit 110 when provided together with the first processing unit 110.

The first processing unit 110 may be provided as a front-load type clothing treatment device. The second processing unit 120 may be provided as a top-load type clothing treatment device.

At this point, the second processing unit 120 may be provided in a drawer type in order to avoid interference with the front-load type clothing treatment device.

In other words, the second processing unit 120 may include a drawer 121*a* provided to be taken out forward from an inside of the second cabinet 121 and may include a clothing receiving unit for receiving clothing inside the drawer 121*a*.

Meanwhile, since the first processing unit 110 may be seated on an upper part of the second processing unit 120, a lower part of the first cabinet 111 of the first processing unit 110 may include a plurality of connection units 111*a* seated on an upper part of the second cabinet 121 of the second processing unit 120, and the upper part of the second cabinet 121 of the second processing unit 120 may include a groove (not illustrated) to which a connection unit 111*a* may be seated to be received.

Meanwhile, when the first processing unit 110 and the upper part of the second processing unit 120 are coupled, only a controller 700 provided to one of the first processing unit 110 and the second processing unit 120 may be provided to collectively control the first processing unit 110 and the second processing unit 120.

To this end, the connection unit 111*a* may be provided as a connector for sending electric signals of the first processing unit 110 and the second processing unit 120.

Meanwhile, in order to prevent flipping over when the drawer 121*a* is taken out, the second processing device 120 may be provided so as to operate only when the first processing device 110 is seated on the upper part of the second processing device 120.

A control panel C may be provided to the first processing unit 110 to display states of the first processing unit 110 and the second processing unit 120 and to input operation instructions to the first processing unit 110 and the second processing unit 120.

Unlike illustration of FIG. 1A, the first processing unit 110 may be provided in a top-load type, which does not exclude that the second processing unit 120 is provided in a front-load type. Furthermore, the second processing unit 120 is allowed to be provided to any one of the upper part, the lower part, and the side surface of the first processing unit 110.

FIGS. 1B and 1C illustrate example embodiments in which the first processing unit 110 and the second processing unit 120 are provided integrally or to form one body.

FIGS. 1B and 1C illustrate that the first processing unit 110 is provided in the front-load type and the second processing unit 120 is provided in the top-load type. FIG. 1B illustrates that the second processing unit 120 is provided to the lower part of the first processing unit 110, and FIG. 1C illustrates that the second processing unit 120 is provided to the upper part of the first processing unit 110.

Referring to FIG. 1B, the first processing unit 110 and the second processing unit 120 may be provided inside one cabinet 111 forming the exterior. The first cabinet 111 which forms an exterior of the first processing unit 110 and the second cabinet 121 which forms an exterior of the second processing unit 120 may be coupled to form one body.

In order to avoid interference with the first processing unit 110, the second processing unit 120 may include the drawer 121*a* provided to be taken out forward from the second cabinet 121 and may include the clothing receiving unit for receiving clothing inside the drawer 121*a*.

The control panel C for displaying the states of the first processing unit 110 and the second processing unit 120 and inputting the operation instructions to the first processing unit 110 and the second processing unit 120 may be provided to the first cabinet 111.

At this point, since the first processing unit 110 is provided to the upper part of the second processing unit 120, the control panel C may be provided to the first cabinet 111 which includes the first processing unit 110.

Referring to FIG. 1C, the first processing unit 110 and the second processing unit 120 may be provided inside one cabinet 111 forming the exterior.

The control panel C for displaying the states of the first processing unit 110 and the second processing unit 120 and inputting the operation instructions to the first processing unit 110 and the second processing unit 120 may be provided to the cabinet 111.

At this point, since the first processing unit 110 is provided to the upper part of the second processing unit 120, the control panel C may be provided to the cabinet 111 which includes the second processing unit 120.

Figure 2A:
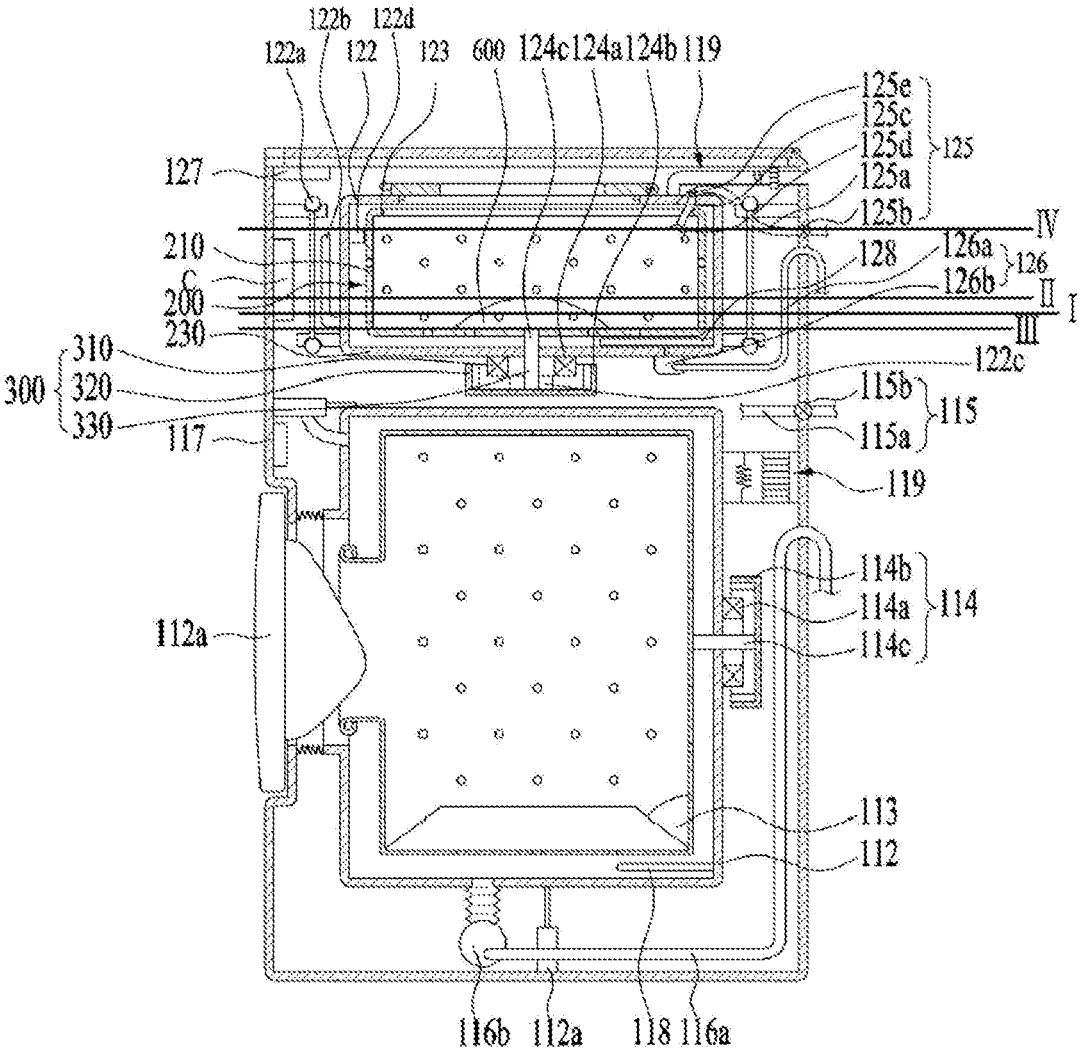
FIGS. 2A and 2B are diagrams illustrating an inner structure of a clothing treatment device according to example embodiments of the present disclosure.
Figure 2B:
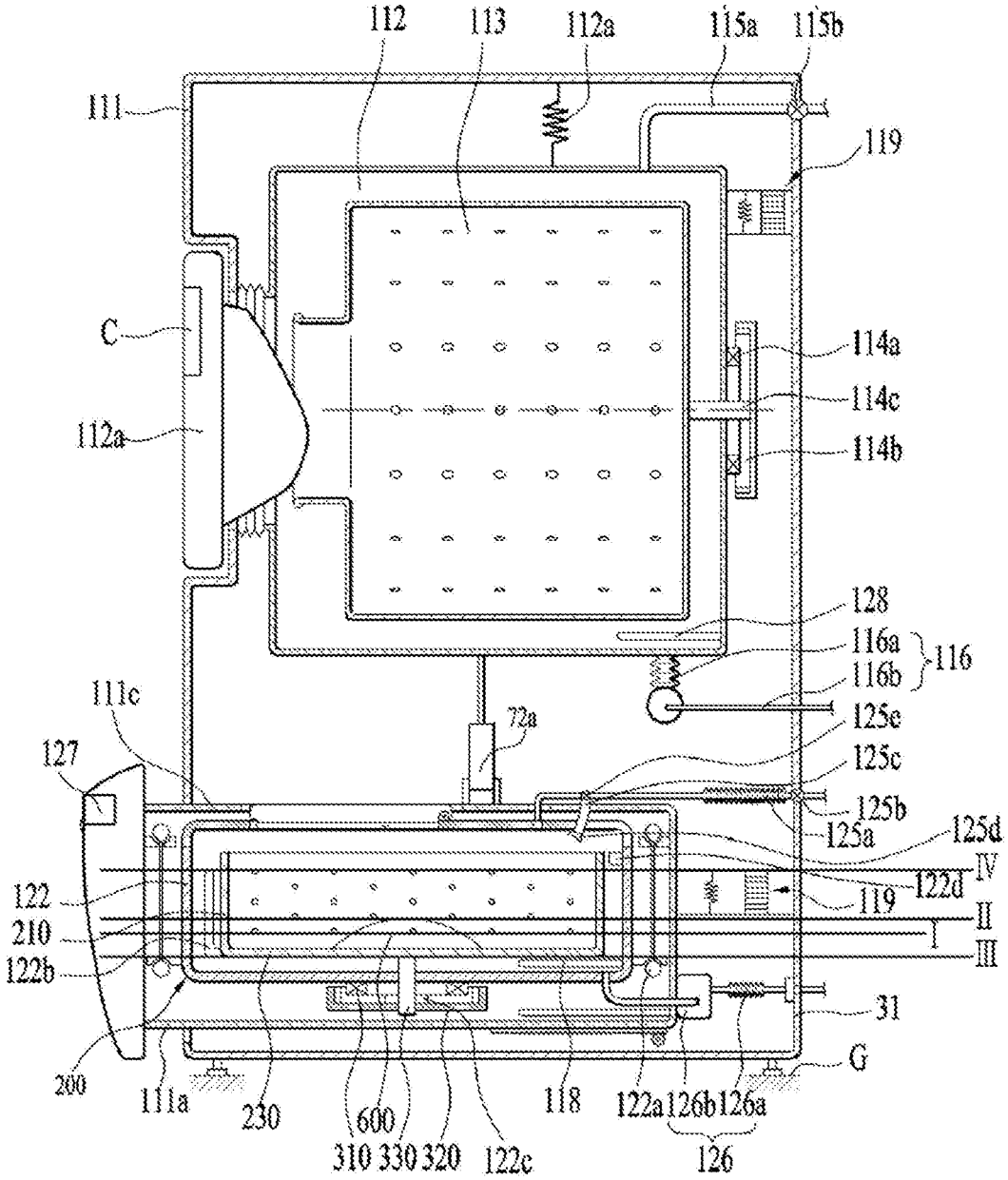

FIGS. 2A and 2B are diagrams illustrating an inner structure of a clothing treatment device according to example embodiments of the present disclosure. Referring to FIGS. 2A and 2B, the inner structure of the clothing treatment device is illustrated.

FIG. 2A illustrates that the first processing unit 110 is provided to a lower part of the second processing unit 120. FIG. 2B illustrates that the first processing unit 110 is provided to an upper part of the second processing unit 120.

FIGS. 2A and 2B illustrate that the first processing unit 110 is provided inside one cabinet 111 together with the second processing unit 120. However, it is merely for a description, and the first processing unit 110 and the second processing unit 120 are allowed to be provided separately so that an additional cabinet is included.

In addition, FIGS. 2A and 2B illustrate that the first processing unit 110 is provided in a front-load type and that the second processing unit 120 is provided in a top-load type. However, it is merely for a description, and the first processing unit 110 and the second processing unit 120 are allowed to be provided in a different type.

The first processing unit 110 may include first clothing receiving units 112 and 113 that are provided inside the first cabinet 111 and receive clothing. The second processing unit 120 may include a second clothing receiving unit 200 that is provided inside the second cabinet 121 and receives clothing.

When the first processing unit 110 is provided as a washing device, the clothing receiving units 112 and 113 may include a first tub 112 for storing water and a first drum 113 that is provided to the first tub 112 in a rotatable manner and receives the clothing. The first processing unit may further include a first driving unit 114 that is provided at one surface of the first tub 112 and rotates the first drum 113, a first water supply unit 115 for supplying water to the first tub 112, and a first drainage unit 116 for draining water from the first tube 112. The first driving unit 114 may include a first stator 114*a* for forming a rotating magnetic field, a first rotor 114*b* provided so as to be rotated by the rotating magnetic field, and a rotating shaft 114*c* connecting surfaces of the rotor and the drum. Also, it is allowed to include a motor provided at one side of the first tub 112, a rotating shaft connecting one surface of the drum and provided to protrude from a rear surface of the tub, a pulley provided to the rotating shaft and the motor, and a belt connecting the pulley.

The first water supply unit 115 may include a first water supply pipe 115*a* connecting an external water supply source and the first tub 112 and include a first water supply valve 115*b* for adjusting an amount of flow in the first water supply pipe 115*a*.

In addition, the first water drainage unit 116 may include a first water drainage pipe 116*a* provided to extend from the first tub 112 to an outside of the cabinet 111 and may include a first water drainage pump 116*b* provided to provide power to drain water from the first tub 112 and to communicate with the first water drainage pipe 116*a*.

When provided as the washing device, the second processing device 120 may include an element for performing a same function, which is only different from that of the first processing unit 110 in size.

In other words, the second processing unit 120 may include a second tub 122 that is provided to one of an upper part, a lower part, and a side surface of the first processing unit 110 and receives water, a second drum 200 that is provided to the second tub 122 in a rotatable manner and receives the clothing, a second driving unit 124 that is provided at one surface of the second tub 122 and rotates the second drum 200, a second water supply unit 125 for supplying water to the second tub 120, and a second water drainage unit 126 for draining water from the second tub 120.

The second drum 200 may be provided in a cylindrical form.

Since the second processing unit 120 has a high probability of being used as an auxiliary clothing treatment device, the second processing device 120 may be provided to have a volume smaller than that of the first processing unit 110. However, the second processing unit 120 may be required to secure washing efficiency and a washing capacity at a predetermined level or more.

To this end, in the second drum 200, a diameter of a drum introduction port provided so that clothing may exit and enter or a diameter of a floor surface 230 may be provided to be longer than widths of surfaces 210 adjacent to the introduction port.

In other words, a diameter of a surface connected to a rotating shaft 330 may be provided to be longer than a width of a surface parallel to the rotating shaft. For example, when the drum introduction port faces an upper part, the second drum may be provided to have a width longer than a height.

Through this, the second drum 200 may further strengthen centrifugal force by widening a diameter of a surface rotated by a rotating shaft and greatly increase the washing efficiency for the clothing received into the second drum 200. Also, the second drum 200 may secure the washing capacity by extending an area for receiving and supporting the clothing.

Meanwhile, the first processing unit 110 may include a first support unit 112*a* for supporting the first tub 112 at the cabinet 111, and the second processing unit 120 may include a second support unit 122*a* for supporting the second tub 122 at the cabinet 111.

The first support unit 112*a* and the second support 122*a* may be provided in combination with a spring and a damper or in combination with a bracket and a connection bar.

The first support unit 112*a* and the second support 122*a* are allowed to be provided in any form if the first support unit 112*a* and the second support unit 122*a* may support the first tub 112 and the second tub 122, respectively.

Meanwhile, the cabinet 111 may further include a partition 111*b* for dividing the first processing unit 110 and the second processing unit 120.

When the second processing unit 120 is provided in a drawer type, a drawer provided to be taken out from the cabinet 111 may be provided, and the second tub 122 and the second drum 200 may be provided inside the drawer.

The second driving unit 300 may include a second stator 310 for forming a rotating magnetic field, a second rotor 320 provided so as to be rotated by the rotating magnetic field, and a second rotating shaft 330 connecting surfaces of the rotor and the drum.

Meanwhile, the driving unit 300 is allowed to include a motor provided at one side of the second tub 122, a rotating shaft connecting the drum and provided to protrude from a rear surface of the tub, a pulley provided to the rotating shaft, and a belt connecting the pulley.

The second water supply unit 125 may include a second water supply pipe 125*a* connecting an external water supply source and the second tub 122 and include a second water supply valve 125*a* for adjusting an amount of flow in the second water supply pipe 125*a*.

Meanwhile, the second water supply unit 125 may further include a branch pipe 125*c* branched from the second water supply pipe 125*a* and a spray nozzle 125*d* provided to face an inside of the second tub from an end of the branch pipe 125*c*.

A branch valve 125*e* may be provided as a three-way valve or the like to a part at which the branch pipe 125*c* and the second water supply pipe 125*a* are connected. The spray nozzle 125*d* may be provided at an end of the second water supply pipe 125*a*.

The spray nozzle 125*d* may supply supplied water to the second tub 122 in a form of spray.

Through this, clothing received into the second tub 122 or the second drum 200 may be wetted widely.

In addition, the second water drainage unit 126 may include a second water drainage pipe 126*a* provided to extend from the second tub 122 to the cabinet 121 and may include a second drainage pump 126*b* provided to provide power to drain water in the second tub 122 and to communicate with the second water drainage pipe 126*a*.

The first processing unit 110 may include a first heater 118 for heating water in the first tub 112 and a hot air supply unit 119 for supplying hot air to the first tub 112.

It is desirable that the first heater 118 is to be provided to a lower part of the first tub 112, and a sheath heater may be applied.

Also, the first heater 118 is allowed to be provided in any form if the first heater 118 may heat the water in the first tub 112.

The first hot air supply unit 119 may include a duct 119*a* for supplying air to the first tub 112, a duct heater 119*b* provided inside the duct 119*a*, a fan 119*c* for supplying air in the duct 119*a* to the first tub 112.

The second processing unit 120 also may include a second heater 128 and a second hot air supply unit 129 as described for the first processing unit 110.

Meanwhile, the first processing unit 110 and the second processing unit 120 may include a power source unit for supplying power to the first processing unit 110 and the second processing unit 120.

The power source unit may be provided as a switch provided to the cabinet 111 or may be desirably provided at one side of the control panel C.

The power source unit may include a first power source unit 117 for supplying the power to the first processing unit 110 and a second power source unit 127 for supplying the power to the second processing unit 120.

Meanwhile, at least one of the first processing unit 110 and the second processing unit 120 may be provided as a drying device. Configuration of a water supply unit, a drainage unit, a tub, and a heater may be omitted in one of the first processing unit 110 and the second processing unit 120, which is provided as the drying device.

Furthermore, at least one of a water level sensor 122*b* for sensing a water level of at least one of the first tub 112 and the second tub 122, a temperature sensor 122*d* for sensing a temperature associated with the first tub 122 and the second tub 122, a load sensor 122*c* for sensing loads on the first tub 112 and the second tub 122, and a vibration sensor 122*e* for sensing vibration of the first tub 112 and the second tub 122 may be included. In example embodiments, each sensor is described as being provided to the second tub 122 in example embodiments, but is not limited thereto. Each sensor may be additionally provided to each tub or provided at a position at which physical values of two tubs are measurable at a same time.

Figure 3:
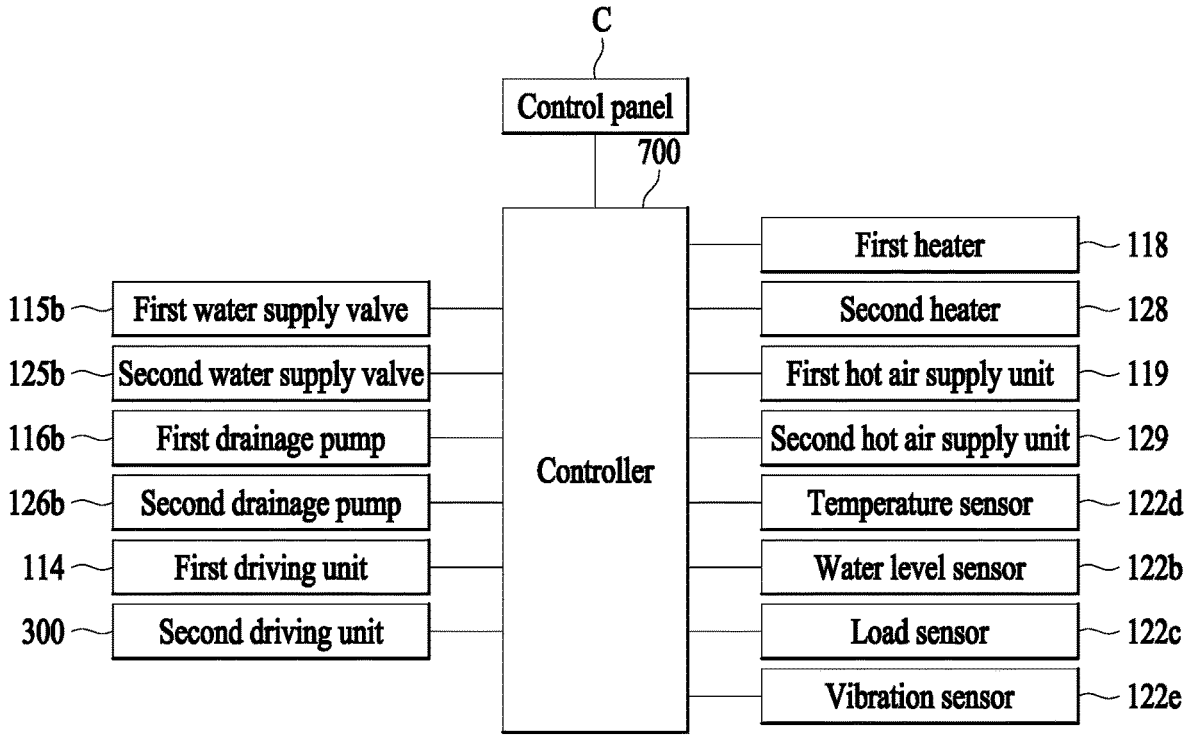
FIG. 3 is a diagram illustrating configuration of a controller of a clothing treatment device according to example embodiments of the present disclosure.

FIG. 3 is a diagram illustrating configuration of a controller of a clothing treatment device according to example embodiments of the present disclosure. Referring to FIG. 3, the controller of the clothing treatment device and each element of the clothing treatment device which is controlled by the controller are illustrated.

The controller 700 may control all elements of the first processing unit 110 and the second processing unit 120. In addition, the controller 700 may be connected to the control panel C so as to send and receive a control signal. The controller 700 may be provided integrally with the control panel C or provided separately from the control panel C.

Also, the controller 700 may control the first water supply valve 115*b*, the second water supply valve 125*b*, the first driving unit 114, the second driving unit 300, the first water drainage pump 116*b*, and the second water drainage pump 126*b*.

Also, the controller 700 may control the first heater 118 and the first hot air supply unit 119 provided to the first processing unit and control the second heater 128 and the second hot air supply unit 129 provided to the second processing unit.

As described above, when the first processing unit 110 and the second processing unit 120 are provided separately, the connection unit 111*a* for electrically connecting the first processing unit 110 and the second processing unit 120 may be provided.

The connection unit 111*a* may perform a role of sending the control signal of the controller 700 which is provided to one of the first processing unit 110 and the second processing unit 120. Hereinafter, control methods and configuration of a washing stroke, a rinsing stroke, and a dehydration stroke may be described with the second processing unit 120 as a reference.

However, this is to merely avoid redundant descriptions and may be identically applied to the first processing unit 110 when a limitation that performance is to be always done in the second processing unit 120 is absent.

When the second processing unit 120 is provided as a washing device, the second processing unit 120 may basically perform the washing stroke for removing a foreign substance of clothing, the rinsing stroke for removing the foreign substance of the clothing and detergent, and the dehydration stroke for removing water of the clothing.

The washing stroke and the rinsing stroke may be repeated a plurality of times. Each time one washing stroke is ended, and each time one rinsing stroke is ended, the controller 700 may open the second water supply valve 125*b* to supply water to the second tub 122 and may control, after operating the driving unit 300, the second drainage pump 126*b* to drain water from the second tub 122.

The dehydration stroke may be performed after the washing stroke and the rinsing stroke are completely ended.

The dehydration stroke is a stroke in which the controller 700 controls the second driving unit 300 to rotate the second drum 200 at a high speed and eject water of clothing received into the second drum 200 to an outside of the second drum 200 by using centrifugal force.

Before performing the dehydration stroke, the controller 700 may maximally drain water from the second tub 122.

This is because the second driving unit 300 may have a large load due to resistance of the water when the second drum 200 is rotated while the water is in the second tub 122.

However, when all the water is drained from the second tub 122 after the rinsing stroke is completed, the clothing inside the second drum 200 may be eccentric. In other words, as the second drum 200 is rotated during the rinsing stroke, the clothing may be gathered at one point, not evenly distributed.

In such a state, when the second drum 200 is suddenly rotated at the high speed, an imbalance may be intensified, and great vibration may be generated in the second drum 200.

When a vibration amplitude of the second drum 200 is large, dehydration performance may be greatly decreased because an angular velocity is not constant.

Also, when vibration greatly occurs in the second drum 200, the controller 700 may perform an fault operation of immediately ending the dehydration stroke because there is concern that the second drum 200 may collide with the second tub 122 or that the second rotating shaft 330 of the driving unit 300 may have an intense load.

As a result, when the vibration which is due to the clothing being eccentric greatly occurs in the second drum 200, the dehydration stroke may not be normally performed.

In order to prevent this, in the dehydration stroke after the washing stroke or the rinsing stroke is ended, the second driving unit 300 may be rotated, and simultaneously, the water in the second tub 122 may be drained.

That is, the second drum 200 may be rotated while the water is in the second tub 122. Although the second drum 200 is rotated, the clothing may move while floating through the water, and eccentricity may be resolved. Through this, a clothing untangling effect of untangling the clothing during all of a process before the dehydration stroke and a process of the dehydration stroke may be derived, and the vibration may be relieved.

Removing the water of the clothing while the eccentricity is resolved by draining the water in the second tub 122 and simultaneously rotating the second drum may be defined as dehydration with remaining water. Removing the water of the clothing by rotating the second drum 200 at the high speed with the water in the second tub 122 all drained may be defined as general dehydration so as to be distinguished from the dehydration with the remaining water.

Meanwhile, in example embodiments, the dehydration with the remaining water may be implemented with a method of limiting a degree of drainage in a period before a drum is rotated for the dehydration stroke, starting rotation of the drum after stopping the drainage while washing water is remained in the drum, and performing the drainage at a predetermined rotation speed or more. As such, the remaining washing water may reduce the vibration in a period of a rotation speed at which the vibration may occur due to the rotation of the drum. In addition, as described in the following example embodiments, a portion of the washing water is drained after the rinsing stroke, and then an operation of adding water into the drum after stopping the drainage and starting the rotation of the drum may be performed. Also, whether to add the water and an amount to add the water may be determined based on at least one of a total weight of contents inside the drum and the vibration which is sensed with the rotation. As such, vibration control may be further effectively performed by adjusting an amount of the remaining water when the drum is rotated for the dehydration stroke.

A rotation speed of the second drum 200 in the washing stroke or the rinsing stroke may be defined as a first speed.

A rotation speed of the second drum 200 in the general dehydration may be faster than a rotation speed of the second drum 200 in the dehydration with the remaining water. The rotation speed of the second drum 200 in the dehydration with the remaining water may be referred to as a second speed, and the rotation speed of the second drum 200 in the general dehydration may be referred to as a third speed.

Meanwhile, the second speed may be faster than the first speed. This is because the second speed may be one part of a dehydration operation as an operation of the dehydration with the remaining water.

After the washing stroke or the rinsing stroke is completed, when the dehydration stroke is performed, and when the water being all drained is sensed after the dehydration with the remaining water, subsequently performing the general dehydration may be identical. This is because, in the dehydration stroke itself, it is possible to solve the eccentricity of the clothing and prevent the imbalance by performing untangling the clothing.

However, the above-described effect may be derived only when a predetermined weight or more of clothing is received inside the second drum 200. When the predetermined weight or less of clothing is received inside the second drum 200, the vibration of the second drum 200 may be further intensified when the dehydration with the remaining water is performed.

When the predetermined weight or less of clothing is received inside the second drum 200, the water which is received in the second tub 122 may generate larger vibration by rotation of the second drum 200. Shaking or a wave phenomenon of the water in the second tub 122 may occur by the second drum 200 because the predetermined weight or less of clothing does not absorb the shaking or the wave phenomenon.

Also, when the predetermined weight or more of clothing is received inside the second drum 200, a sum of a weight of the water and a weight of the clothing in the second tub 122 and a range of a possible rotation speed of the second drum 200 at a time of the dehydration with the remaining water may be in an area including a resonance point at which excessive vibration of the second processing unit 120 occurs.

In other words, when the weight of the clothing received in the second drum 200 is less than or equal to the predetermined weight, a weight of the entire second processing unit and the rotation speed of the second drum 200 may correspond to an area in which excessive vibration occurs.

Thus, although the dehydration with the remaining water is performed, the larger vibration may rather occur, and the dehydration stroke may not be properly performed.

Therefore, the excessive vibration may be required to be prevented by varying a control method depending on a weight of the clothing, a time point of the drainage, and a rotation speed of the drum.

Meanwhile, in example embodiments, the temperature sensor **122*d* may sense respective temperatures of an inside of each tub or sense a temperature of an operation element associated with each drum. More specifically, the temperature sensor 122*d* may measure a temperature of a power module for driving a motor associated with an operation of each drum. As such, a load of the power module may be determined according to temperature measurement so that the controller 700 is allowed to control an operation. The power module may be accompanied by a temperature increase depending on a supplied electric current, and an operation of the power module may be required to be controlled within an allowed temperature. Thus, when the temperature of the power module which is measured by the temperature sensor 122*d* exceeds a preset range, the rotation speed of the drum may decelerate in order to reduce the load. As an example, when a weight of a washing subject that is put into the drum is heavy, electricity consumption may be increased even when rotation is performed at an identical rotation speed, and accordingly, the temperature of the power module may be increased. When the temperature of the power module is greater than or equal to a preset value, the load of the power module may be reduced by decreasing the weight of the washing subject in the drum by draining water or reducing the rotation speed. In addition, the clothing treatment device of example embodiments may include one or more temperature sensors 122*d***, and a position of a temperature sensor is not limited to a position described in the figure.

Meanwhile, in example embodiments, the vibration sensor **122*e* may sense the vibration due to the rotation of the drum. Through this, the vibration which occurs by the rotation during a washing course, and accordingly, the controller 700** may control the rotation. Through this, when a dehydration course and high-speed rotation is performed, vibration therein may be measured. When the vibration exceeds a preset value, a control method for prevention thereof may be performed. For example, an operation of a washing machine may be controlled in order to allow the rotation by reducing the rotation speed or so that the dehydration operation is performed after a clothing dispersion operation is performed. In example embodiments, the clothing dispersion operation may be performed by adjusting the rotation speed of the drum, and placement of the clothing inside the drum may be changed by accelerating or decelerating of the rotation speed of the drum. Meanwhile, in example embodiments, when a margin is present in the temperature of the power module in a first dehydration stroke when the clothing dispersion operation is performed, an additional water supply operation may be performed.

Through this, the vibration may be reduced when clothing having fabric texture that may greatly generate the vibration is dehydrated.

Figure 4:
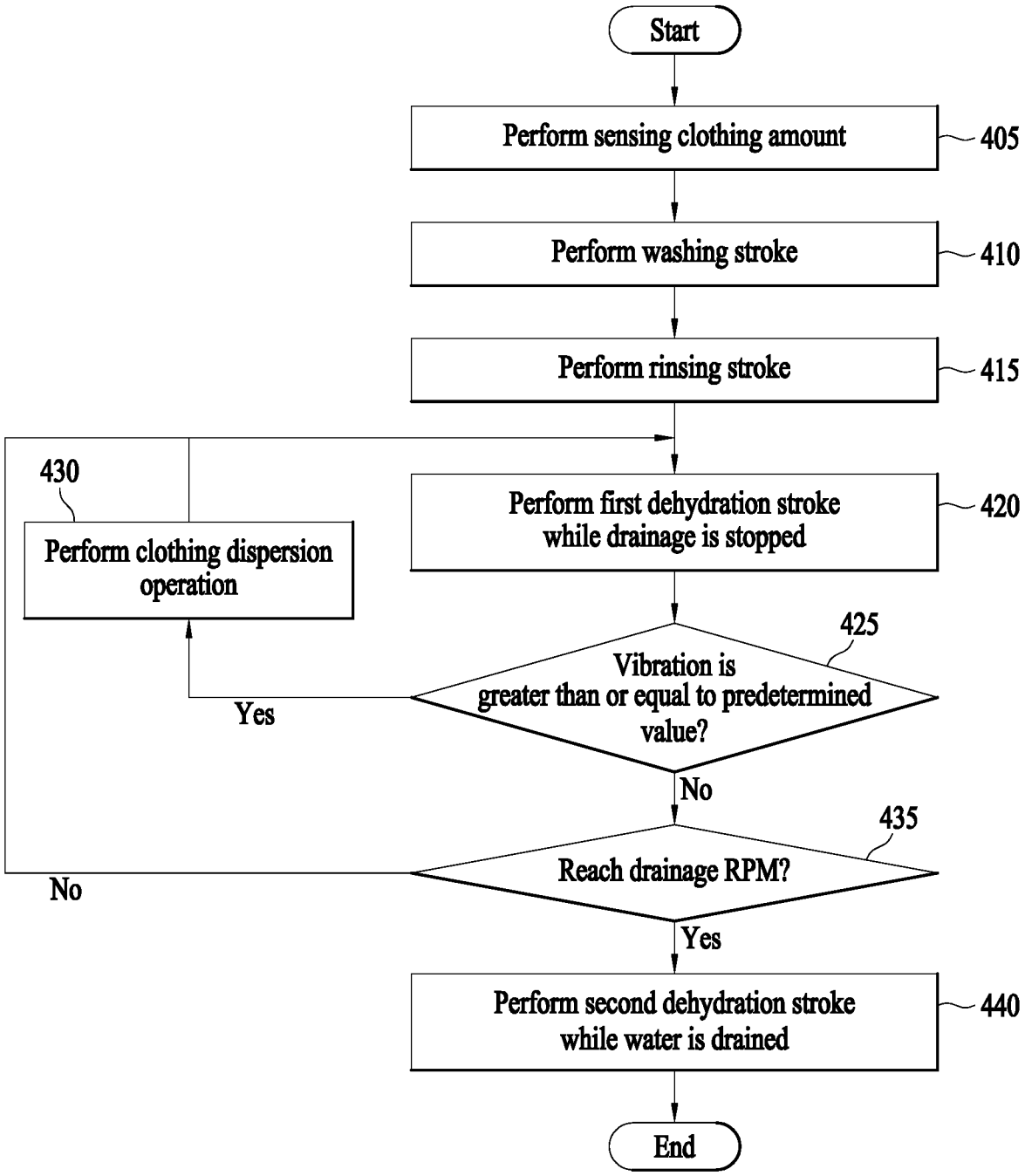
FIG. 4 is a flowchart illustrating a washing process according to example embodiments of the present disclosure.

FIG. 4 is a flowchart illustrating a washing process according to example embodiments of the present disclosure.

Referring to FIG. 4, the washing process of a clothing treatment device including a dehydration stroke according to example embodiments of the present disclosure is illustrated.

In operation 405, the clothing treatment device may perform sensing a clothing amount. The sensing of the clothing amount is an operation of sensing a weight of clothing received inside a drum, and a process associated with washing may be adaptively adjusted thereafter according to the sensed clothing amount. The sensing of the clothing amount may be performed through a load sensor provided to the clothing treatment device or may be performed with a method of sensing the weight of the clothing through measurement of a load depending rotation of the drum without the load sensor. A controller may record the sensed clothing amount and control each operation in the following operations.

In operation 410, the clothing treatment device may perform a washing stroke. For the washing stroke, water supply may be performed, and the drum may be rotated. Also, detergent may be introduced with the water supply to perform the washing. The drum may be rotated in the washing stroke, and through this, the clothing inside the drum may be washed.

In operation 415, the clothing treatment device may perform a rinsing stroke. Another water supply operation may be additionally provided for the rinsing stroke, and a detergent component may be removed from the clothing through the rinsing stroke. Meanwhile, in example embodiments, the washing stroke and the rinsing stroke may be performed without being distinguished additionally. However, generally, additional water supply may be performed before the rinsing stroke. In addition, drainage may be performed during the rinsing stroke depending on example embodiments, and the controller may control an amount of remaining water in a tub after the drainage. Through this, the amount of the remaining water in the tub may be adjusted in an operation in which the dehydration stroke which is subsequently performed is started. In example embodiments, the amount of the remaining water may be determined based on at least one of a weight of laundry in the drum, an attribute of the laundry, and a temperature of a power module. Meanwhile, the drainage may be performed through a drainage pump, but is not limited thereto. The drainage may be also performed in a method of draining water inside the tub to an outside by an action of gravity or the like without additional control of the pump. In example embodiments, the weight of the laundry may be referred to as the clothing amount, and the attribute of the laundry may be referred to as fabric texture.

In operation 420, the clothing treatment device may perform a first dehydration stroke in a state in which the drainage is stopped. In example embodiments, when the first hydration stroke is started, dehydration may be performed without draining at least a portion of rinsing water after the rinsing stroke. Through this, abnormal vibration that may occur with resonance occurrence due to the rotation may be reduced by using remaining rinsing water as a weight for a weight increase in a driving unit with which the rotation is performed. In example embodiments, by the first dehydration stroke, an operation of accelerating a rotation speed of the drum up to drainage RPM in the state in which the drainage is stopped. Meanwhile, in example embodiments, the rinsing water which is not drained when the first dehydration stroke is performed may be referred to as the remaining water, and the amount of the remaining water may be determined variously depending on a washing environment as set in the above operations.

In operation 425, the clothing treatment device may determine whether vibration is greater than or equal to a predetermined value while accelerating up to the drainage RPM. Meanwhile, in example embodiments, a predetermined vibration value may be a preset value or a value determined adaptively depending on the clothing amount in the clothing treatment device. When a value of the vibration is greater than or equal to the preset value, since a user may have inconvenience, adjustment according thereto is required when the vibration value is greater than or equal to the predetermined value.

When the vibration value is greater than or equal to the predetermined value, the clothing treatment device may perform a clothing dispersion operation in operation 430. Clothing dispersion may include an operation of re-placing a position of the laundry inside the drum. In addition, in example embodiments, the clothing dispersion operation may include a process of additional water supply. In example embodiments, the vibration may vary depending on an amount and placement of the laundry inside the drum, and the vibration at a time of the rotation of the drum may be reduced through at least one of the re-placement of the laundry and the additional water supply.

When the vibration value is less than the predetermined value, in operation 435, the clothing treatment device may identify whether the rotation speed of the drum reaches the drainage RPM. In example embodiments, generally, the drainage RPM may be greater than or equal to a resonance RPM band, but is not limited thereto. Also, in example embodiments, the drainage RPM may be determined depending on a weight of a load in the drum. In example embodiments, the weight of the load may be determined based on at least one of the weight of the laundry or a weight of the remaining water. An operation load may be increased in the driving unit for rotating the drum depending on the weight of the load. In example embodiments, the operation load of the driving unit may be identified based on the temperature of the power module. In example embodiments, in dehydration with the remaining water, an operation load of the drum may be greater when compared to a general dehydration operation, and when the temperature of the power module reaches a critical temperature accordingly, control may be performed in a direction of decreasing the drainage RPM.

In example embodiments, when the drainage RPM is not reached, the rotation speed of the drum may be increased while the first dehydration stroke is performed.

Meanwhile, in example embodiments, since the drainage is not performed in the first dehydration stroke, the rotation speed of the drum may be increased before a second dehydration stroke is performed. Since the remaining water is maintained and the dehydration is performed up to a time to pass a resonance band, the first dehydration stroke may be referred to as a reserve dehydration stroke.

In example embodiments, when the drainage RPM is reached, in operation 440, the clothing treatment device may perform the second dehydration stroke while performing the drainage. In example embodiments, maximum RPM of the drum in the second dehydration stroke may be higher than maximum RPM in the first dehydration stroke. Meanwhile, the maximum RPM of the drum in the second dehydration stroke may be determined based on the clothing amount. Also, the maximum RPM in the second dehydration stroke may be adjusted based on the vibration value which is previously measured in the first dehydration stroke. Through this, occurrence of the abnormal vibration may be prevented by adjusting the maximum RPM at a time of dehydration based on the amount of the laundry, and the clothing treatment device being operated with stability may be guaranteed because the operation load of the driving module may be limited. Meanwhile, in example embodiments, the drainage may be performed in at least a portion of periods of the second dehydration stroke.

As such, in example embodiments, the dehydration with the remaining water may be performed by leaving the rinsing water in order to prevent the occurrence of the abnormal vibration at the resonance band when the dehydration stroke is performed. Through this, a user satisfaction level may be increased. In addition, a dehydration stroke that is optimized for the laundry and may reduce the occurrence of the abnormal vibration may be performed by adaptively changing the amount of the remaining water and the drainage RPM based on the amount of the laundry or the attribute of the laundry for which dehydration is performed. Such control may be determined based on the temperature of the power module of the driving unit. Through this, the load of the driving module may be allowed not to exceed a set value, and a stable operation may be guaranteed. Meanwhile, in example embodiments, the amount of the remaining water may be sensed by a water level sensor inside the clothing treatment device or sensed by the load sensor inside the clothing treatment device.

Meanwhile, in example embodiments, the drainage may be performed in at least a portion of the periods of the second dehydration stroke. More specifically, when the drainage RPM is reached after the first dehydration stroke, the drainage may be performed in at least a portion of periods among subsequent periods.

Figure 5:
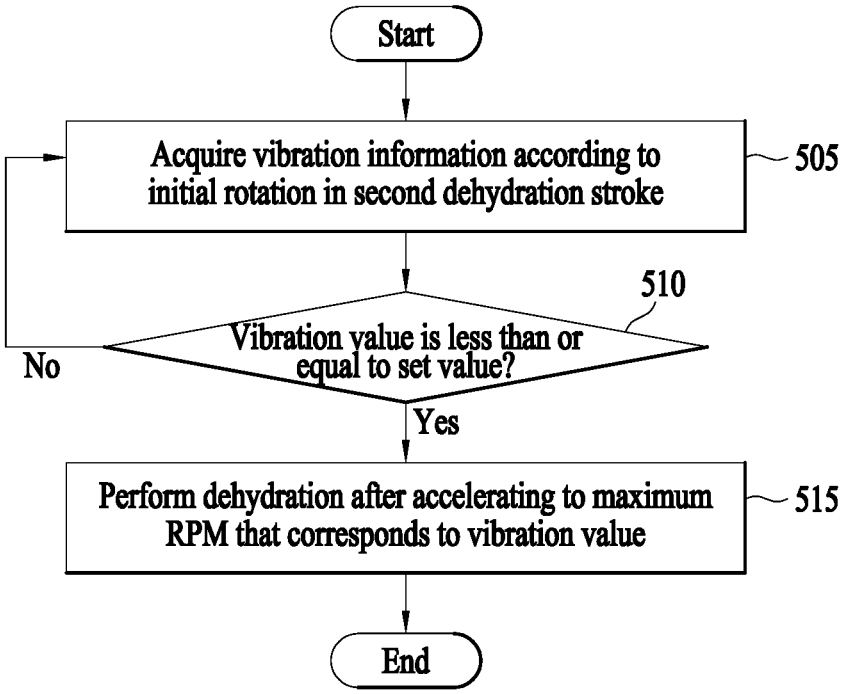
FIG. 5 is a flowchart illustrating a method of adjusting maximum RPM depending on a vibration value according to example embodiments of the present disclosure.

FIG. 5 is a flowchart illustrating a method of adjusting maximum RPM depending on a vibration value according to example embodiments of the present disclosure.

Referring to FIG. 5, a method of determining the maximum RPM depending on the vibration value according to example embodiments is illustrated.

In operation 505, a clothing treatment device may identify vibration information according to initial rotation in a second dehydration stroke. In example embodiments, an initial rotation speed in second dehydration may include a rotation speed after drainage according to a first dehydration stroke is performed. Also, in example embodiments, a number of rotations for acquiring the vibration information may be set. According to an example embodiment, the drainage may be performed at 300 RPM, and then the vibration information may be acquired. In example embodiments, the vibration information may be acquired at RPM at which the drainage is performed, but is not limited thereto. The vibration information may be acquired at higher RPM after acceleration after the drainage is performed. According to an example, the drainage may be performed at 300 RPM, and then the vibration information may be acquired while the rotation is at 500 RPM after acceleration.

In operation 510, the clothing treatment device may identify whether the vibration value is less than or equal to a set vibration value. In example embodiments, the set vibration value is a vibration value defining an abnormal operation and may be vary depending on a setting. When a vibration value larger than the set vibration value is sensed, an initial vibration information acquisition operation may be performed again, and a clothing dispersion operation may be additionally performed before acquisition of the vibration information.

In operation 515, the clothing treatment device may perform dehydration after accelerating to the maximum RPM according to the acquired vibration value. As such, by performing the second dehydration stroke by adjusting the maximum RPM, the vibration value may be prevented from exceeding a predetermined value. In example embodiments, when the vibration value acquired in a previous operation is less than or equal to the set vibration value, a period of the vibration value may be identified. The maximum RPM in the second dehydration stroke may be adjusted according to the period of the vibration value. According to an example, when vibration of a drum is within 2 millimeters (mm), a maximum rotation speed may be set to 1200 RPM. When the vibration of the drum is between 2 mm and 3 mm, the maximum rotation speed may be set to 1010 RPM. When the vibration of the drum is between 3 mm and 4 mm, the maximum rotation speed may be set to 900 RPM.

As such, dehydration with remaining water may be performed in the first dehydration stroke, and the dehydration may be performed above a drum rotation resonance band. Through this, the vibration may be prevented from increasing at the resonance band. The maximum RPM may be adjusted depending on the vibration after the drainage when the second dehydration stroke is performed. Through this, the dehydration may be performed while the vibration value is reduced.

Meanwhile, in example embodiment, the maximum rotation speed in the second dehydration stroke is described as being adjusted based on the vibration information according to the initial rotation in the second dehydration stroke, but is not limited thereto. The maximum rotation speed in the second dehydration stroke may be determined based on a vibration value obtained in at least a portion of periods of the first dehydration. In addition, in example embodiments, the maximum rotation speed in the second dehydration stroke may be determined based on a vibration value obtained after a dehydration resonance band is passed in the first dehydration stroke.

Figure 6:
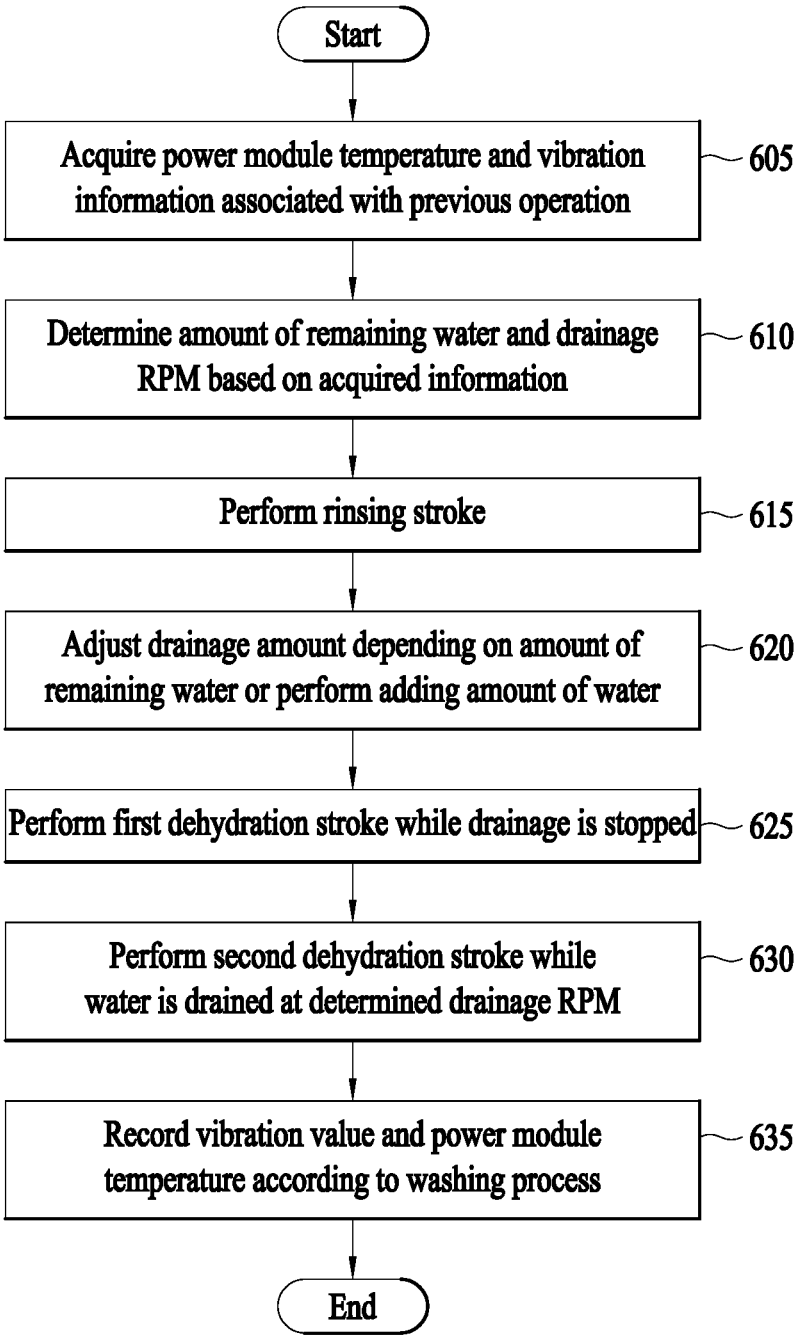
FIG. 6 is a flowchart illustrating a method of adjusting an amount of remaining water, drainage RPM, and maximum RPM in a dehydration stroke based on a power module temperature and vibration information according to example embodiments of the present disclosure.

FIG. 6 is a flowchart illustrating a method of adjusting an amount of remaining water, drainage RPM, and maximum RPM in a dehydration stroke based on a power module temperature and vibration information according to example embodiments of the present disclosure.

Referring to FIG. 6, a method of adjusting an operation for dehydration based on a previous operation information value of a clothing treatment device is illustrated. More specifically, the power module temperature and the vibration information according to a previously performed operation are acquired, and the method of adjusting, based thereon, the amount of the remaining water, the drainage RPM, and the maximum RPM is illustrated.

In operation 605, the clothing treatment device may acquire information associated with a previously performed washing process. The acquired information may be information stored in a storage unit of the clothing treatment device. Also, the information may include a temperature of a power module and vibration information on the power module. In addition, when the temperature and the vibration information are collected, at least one of a clothing amount, fabric texture, the drainage RPM, and the maximum RPM may be acquired together. Each operation parameter has been determined also in the previous washing process, and based on information recorded based thereon, directions of the following operations may be determined.

In operation 610, the clothing treatment device may determine, by referring to the acquired information, the amount of the remaining water and the drainage RPM for laundry for which washing is currently performed. In example embodiments, the amount of the remaining water and the drainage RPM may be determined based on a clothing amount of the current laundry, fabric texture of the current laundry, and a temperature of the power module in a current washing stroke. The maximum RPM may be determined based on at least one piece of information among pieces of the above information which is taken into consideration. Meanwhile, in example embodiments, an operation of determining RPM may be performed when the following rinsing stroke is currently performed or after performance of the rinsing stroke.

In operation 615, the clothing treatment device may perform the rinsing stroke for the laundry. In example embodiments, the rinsing stroke may include the washing stroke.

In operation 620, the clothing treatment device may adjust the amount of the remaining water after the rinsing stroke and before performance of a first dehydration stroke based on at least a portion of the information determined in operation 610. Adjustment of the amount of the remaining water may be performed with a method of adjusting a drainage amount or introducing an additional amount.

In operation 625, the clothing treatment device may perform the first dehydration stroke in a state in which drainage is stopped. The first dehydration stroke may include a process of increasing a rotation speed of a drum until the rotation speed of the drum corresponds to the drainage RPM in a state in which the drainage is not performed. Meanwhile, as described in previous example embodiments, a clothing dispersion process may be additionally performed through measurement of vibration.

In operation 630, when the determined drainage RPM is reached, the clothing treatment device may perform a second dehydration stroke while performing the drainage. A rotation speed in the second dehydration stroke may be higher than the rotation speed in the first dehydration stroke. Also, the clothing treatment device may increase a drum rotation speed up to the maximum RPM determined in operation 610.

In operation 635, the clothing treatment device may record a vibration value and the temperature of the power module according to the overall washing process and use recorded information in order to determine an operation method in another washing process.

As such, an operation value according to a previous washing operation is recorded, and based thereon, the dehydration stroke according to example embodiments of the present disclosure is performed. Through this, there is an effect of applying an environment in which a washing machine is installed or a use method of a user, determining at least one of the amount of the remaining water, the drainage RPM, and the maximum RPM, and accordingly, reducing vibration and preventing an abnormal state.

Figure 7:
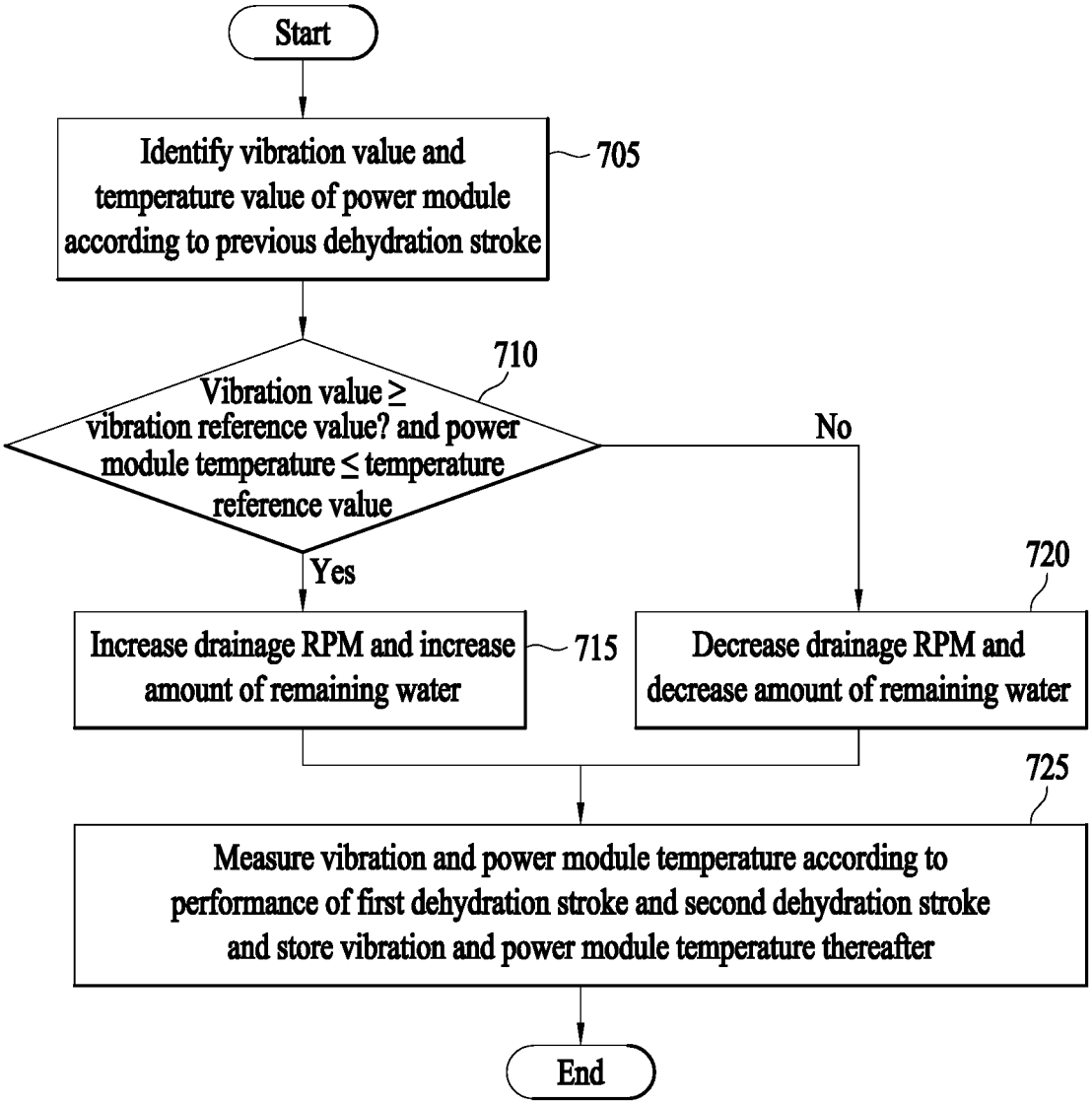
FIG. 7 is flowchart illustrating a method of determining drainage RPM and an amount of remaining water based on a power module temperature and vibration information based on example embodiments of the present disclosure.

FIG. 7 is flowchart illustrating a method of determining drainage RPM and an amount of remaining water based on a power module temperature and vibration information based on example embodiments of the present disclosure.

Referring to FIG. 7, in association with a dehydration stroke of a previous washing process in a clothing treatment device, a vibration value and a temperature of a power module according to rotation RPM in a washing process corresponding to at least one of an amount of remaining water, a clothing amount, and fabric texture may be identified in each dehydration stroke. In addition, according to example embodiments, the vibration value and a temperature value in the washing process corresponding to at least one piece of the above information may be identified, and based thereon, the drainage RPM and the amount of the remaining water may be determined.

In operation 705, information on the vibration value and a temperature value of the power module according to the dehydration stroke of the previous washing process may be identified. More specifically, the information on the vibration value and the temperature value of the power module which are according to a previous operation corresponding to at least one of a clothing amount and fabric texture of laundry for which a current dehydration stroke is to be performed may be identified. Meanwhile, when data corresponding to a matched clothing amount and matched fabric texture is absent, the vibration value and the temperature value of the power module may be identified by estimation based on data corresponding to a similar clothing amount and similar fabric texture.

In operation 710, at least one of whether the vibration value identified in the previous washing process is greater than or equal to a vibration reference value and whether the temperature value of the power module is less than a temperature reference value may be identified.

When the vibration value is greater than the vibration reference value, and when the power module temperature is less than the temperature reference value, in operation 715, the clothing treatment device may increase the drainage RPM and increase the amount of the remaining water. Through such an operation, User satisfaction may be increased by decreasing the vibration value according to the dehydration stroke. Meanwhile, in example embodiments, a method of adjusting the amount of the remaining water and the drainage RPM may be determined variously depending on example embodiments. The clothing treatment device may be controlled in a method of increasing the amount of the remaining water, performing a first dehydration stroke thereafter, and then performing drainage when the temperature of the power module corresponds to the temperature reference value while monitoring the temperature of the power module.

When the vibration value is less than the vibration reference value, or when the temperature of the power module corresponds to the temperature reference value or more, in operation 720, the drainage RPM may be decreased, or the amount of the remaining water may be decreased. Through this, an abnormal operation due to the temperature value of the power module being increased higher than the temperature reference value may be prevented.

In operation 725, a result of operating as such and measured values may be stored and used to determine an operation parameter in another washing process.

Meanwhile, in example embodiments, even when the vibration value is greater than or equal to the vibration reference value, the drainage RPM and the amount of the remaining water may be maintained when a margin between the temperature value of the power module and the temperature reference value is absent.

As such, at least one of the amount of the remaining water and the drainage RPM may be determined based on the vibration value and the temperature value of the power module identified in the previous washing process. Through this, when a temperature margin of the power module is present, vibration in a dehydration course may be reduced by adjusting the at least one of the amount of the remaining water and the drainage RPM in a direction of reducing the vibration. Also, when the temperature value is similar to the temperature reference value or has a small margin, a washing process may be performed in a direction of preventing the abnormal operation with reducing the vibration by adjusting the amount of the remaining water and the drainage RPM in a direction of not increasing the temperature value of the power module. Meanwhile, in example embodiments, it is described that the drainage RPM and the amount of the remaining water are changed, but example embodiments are not limited thereto, maximum RPM may be changed. Changing the maximum RPM may be also performed in a direction of reducing the vibration and in a direction in which the power module does not exceed the temperature reference value.

Figure 8:
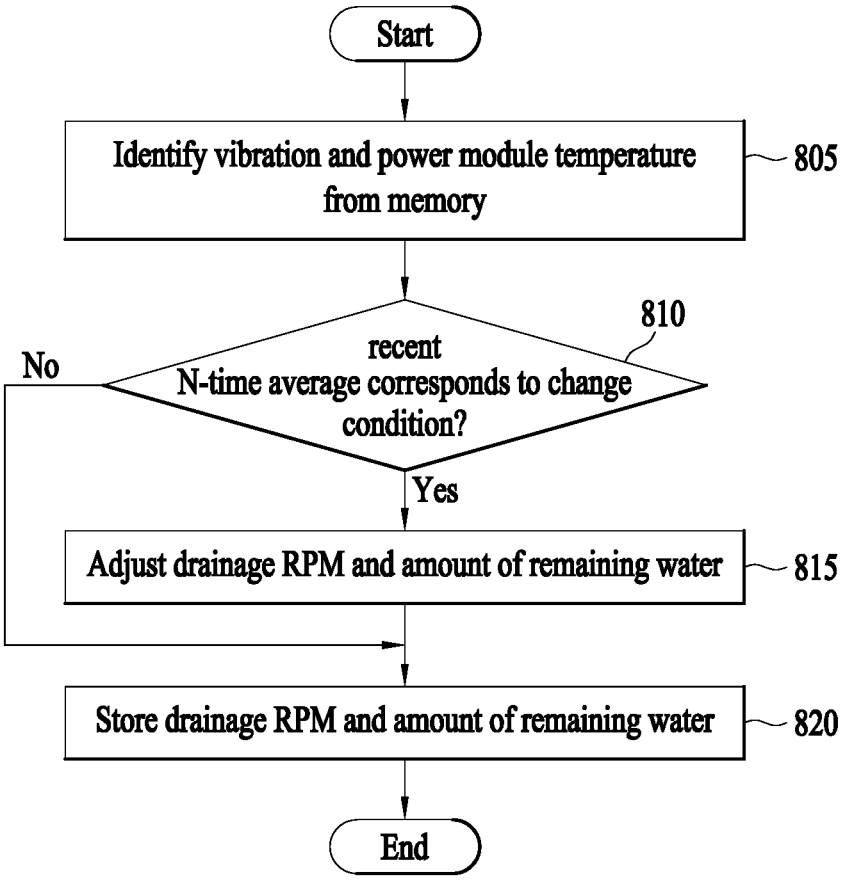
FIG. 8 is a flowchart illustrating a method of adjusting drainage RPM and an amount of remaining water based on a recent operation history according to example embodiments of the present disclosure.

FIG. 8 is a flowchart illustrating a method of adjusting drainage RPM and an amount of remaining water based on a recent operation history according to example embodiments of the present disclosure.

Referring to FIG. 8, the method of adjusting the drainage RPM and the amount of the remaining water based on recent N-time operation values (N is a natural number) based on information stored in a memory is illustrated.

In operation 805, the clothing treatment device may identify vibration and a power module temperature corresponding to a dehydrated clothing amount from the memory.

In operation 810, the clothing treatment device may identify whether to correspond to a change condition based on recent N-time operation information. Determining whether to correspond to the change condition may be performed based on at least one of a comparison between a vibration value and a vibration reference value and a comparison between a temperature value of a power module and a reference temperature value.

In a case of corresponding to the change condition, in operation 815, the drainage RPM and the amount of the remaining water may be adjusted. In example embodiments, when the vibration value is large, and when the temperature value has a margin, at least one of increasing the drainage RPM and increasing the amount of the remaining water may be performed. In example embodiments, when the temperature value is greater than or equal to the reference temperature value, at least one of decreasing the drainage RPM and decreasing the amount of the remaining water. A dehydration stroke may be performed based on the drainage RPM and the amount of the remaining water which are adjusted as such. Subsequently, the changed amount of the remaining water and the changed drainage RPM may be stored in operation 820.

In a case of not corresponding to the change condition, in operation 820, at least one of the existing drainage RPM and the existing amount of the remaining water may be stored.

As such, vibration reduction and malfunction prevention may be optimized by performing evolution of the drainage RPM and the amount of the remaining water based on the vibration value and the temperature value of the power module according to an existing operation.

Figure 9:
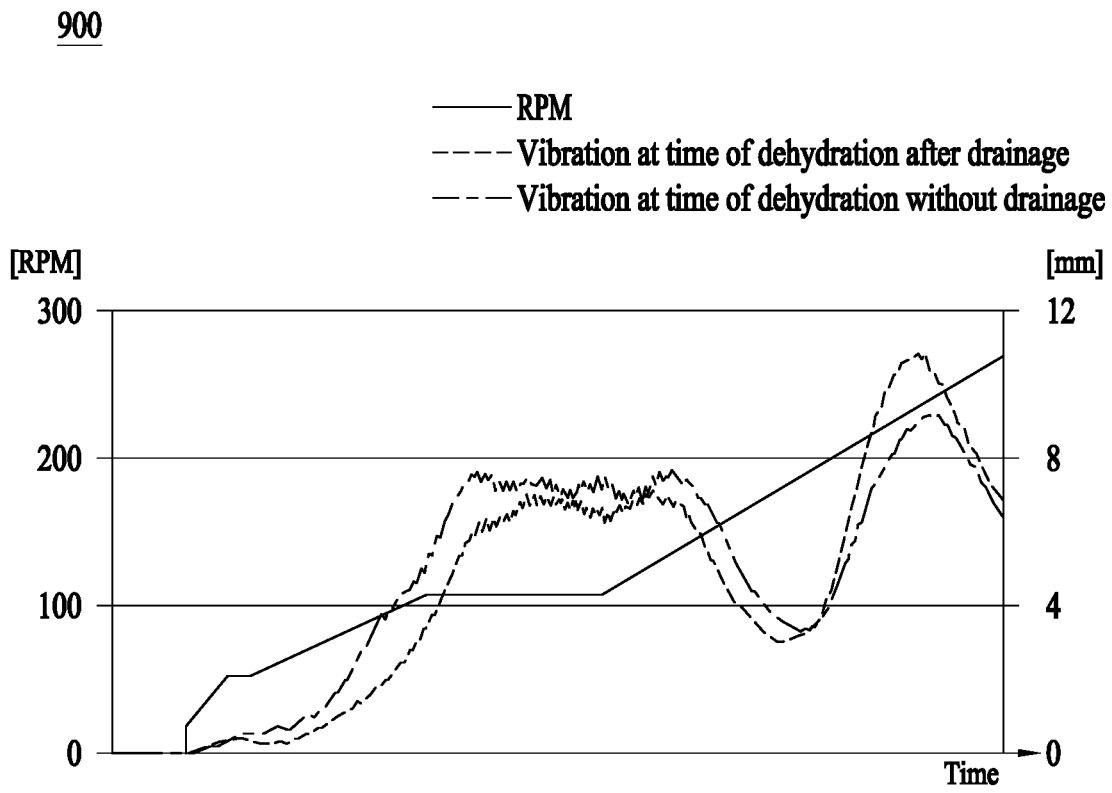
FIG. 9 is a graph for illustrating vibration values at a time of dehydration with remaining water and at a time of dehydration after drainage according to example embodiments of the present disclosure.

FIG. 9 is a graph for illustrating vibration values at a time of dehydration with remaining water and at a time of dehydration after drainage according to example embodiments of the present disclosure.

Referring to FIG. 9, a vibration value in a case of the dehydration after the drainage according to example embodiments of the present disclosure and a vibration value corresponding to RPM in a case of the dehydration without the drainage such as example embodiments of the present disclosure are illustrated. Vibration may be a vibration value of a tub according to drum rotation, but is not limited thereto.

Referring to a graph 900, RPM may be sequentially increased. In example embodiments, when a vibration value is measured while the RPM is maintained to be around 108 RPM, and when the vibration value is greater than or equal to a preset value, a clothing dispersion operation may be performed. Meanwhile, in example embodiment, the RPM may not be limited to 108 RPM. In example embodiments, the vibration values at 108 RPM practically do not have a difference, but a vibration value in a case in which the dehydration with the remaining water is performed may be identified as being larger to some degree.

Afterward, when dehydration is performed while the RPM is increased because the vibration values do not exceed a reference value, the vibration value in a case in which the dehydration after the drainage is performed at around 230 RPM may be identified as being increased further than that in a case in which the dehydration with the remaining water is performed at around 230 RPM. As such, when the dehydration with the remaining water is performed, the vibration may be decreased at a resonance frequency band. When exceeding a resonance frequency, all the vibration values in the dehydration after the drainage and in the dehydration with the remaining water may be decreased. In the dehydration with the remaining water, the drainage may be performed at a subsequent RPM. Through this, a vibration reduction effect may be brought, and in subsequent dehydration, the dehydration may be performed while a load of a driving unit is reduced.

As described above, when the dehydration after the drainage is performed, the vibration may be identified as being decreased at a resonance RPM band or more. When the dehydration with the remaining water without the drainage performed, the vibration may be identified as being decreased at the resonance RPM band. Thus, the drainage may not be performed as described in example embodiments, the dehydration with the remaining water may be performed, and then the drainage may be performed at RPM exceeding the resonance frequency. Through this, the vibration may be decreased, and the load of the driving unit may be reduced by reducing weights of laundry and washing water included inside a drum at high RPM.

Meanwhile, according to example embodiments, the resonance RPM may vary depending on a clothing amount and fabric texture. A controller of a clothing treatment device may adjust drainage RPM in consideration of the clothing amount and the fabric texture. The controller may identify a temperature of a power module while operating and perform control in a direction in which the temperature does not exceed a reference temperature.

Figure 10:
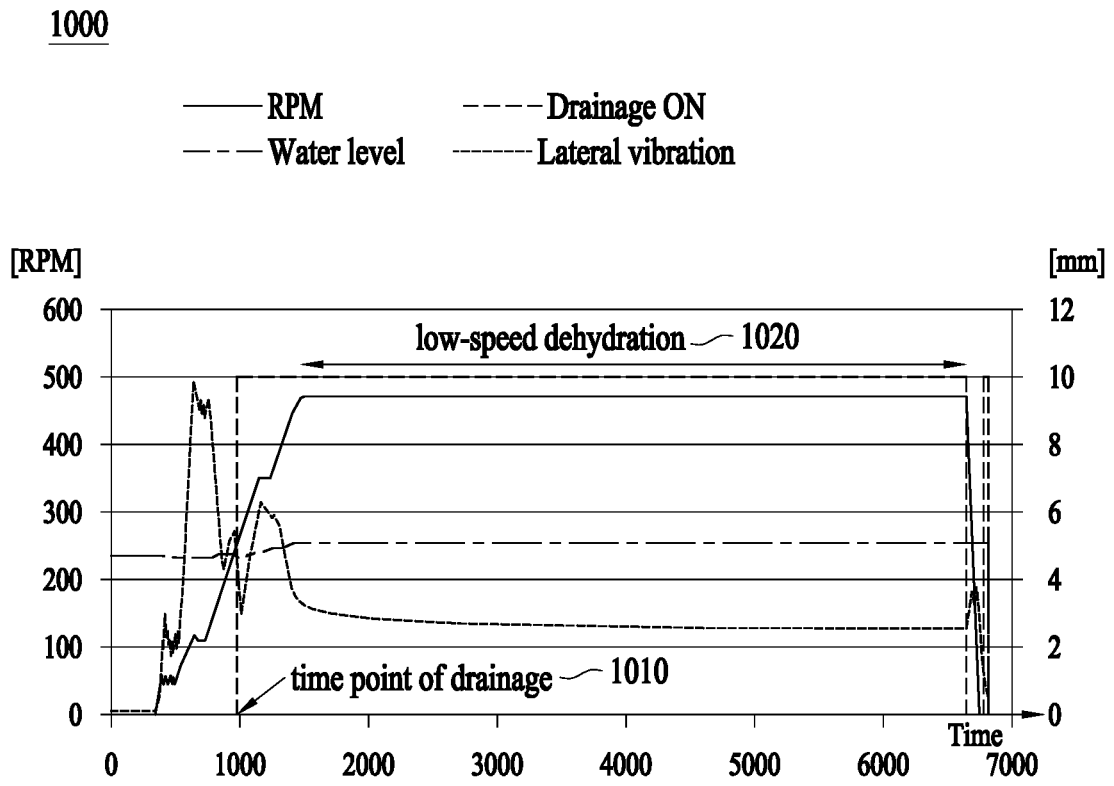
FIG. 10 is a graph illustrating RPM, a drainage operation, a water level, and vibration in a case in which dehydration with remaining water is used according to example embodiments of the present disclosure.

FIG. 10 is a graph illustrating RPM, a drainage operation, a water level, and vibration in a case in which dehydration with remaining water is used according to example embodiments of the present disclosure.

Referring to FIG. 10, a graph 1000 of performing the dehydration with the remaining water when dehydration for laundry generating high vibration is performed.

In example embodiments, as the RPM is increased at a time point at which the drainage is not performed, a vibration value may be identified as being rapidly increased. Accordingly, maximum RPM may be limited in a second dehydration stroke after maximal drainage. Subsequently, as illustrated by reference numeral 1010, the drainage may be performed at around 260 RPM past a resonance band. After that, as illustrated by reference numeral 1020, low-speed dehydration may be performed while the maximum RPM is maintained to be less than 500.

As such, in a case of a load with a high vibration value, the dehydration with the remaining water may be performed, but the maximum RPM may be limited based on at least one of the vibration value before the drainage and an increase in the vibration value after the drainage. As such, by adaptively adjusting the maximum RPM depending on the vibration value, the vibration value may be controlled not to deviate from a predetermined range even when the laundry has an attribute of generating the high vibration.

FIG. 11 is a diagram illustrating a method of setting an evolution variable depending on dehydration with remaining water according to a recent operation value according to example embodiments of the present disclosure.

Referring to FIG. 11, a table 1100 showing information measured in last three times of dehydration according to each clothing amount level (LV) is illustrated.

A clothing amount LV may be identified based on a clothing amount or a weight of clothing, and information on the last three times which corresponds to corresponding clothing amounts may be identified. In example embodiments, the three times are an exemplary value. In dehydration to perform next time, an amount to add water for the dehydration with the remaining water and a drainage time point (RPM) may be adjusted based information on at least one previous operation. Specified information may be include a vibration value sensed in a tub and a temperature of an intelligent power module (IPM) of a driving unit. In example embodiments, a vibration reference value may be 7 millimeters (mm), and an IPM temperature reference value may be set to 90 degrees Celsius (° C.).

When measurement information 1105 on clothing amount LV 1 is identified, tub vibration is within 2 mm and thus within the vibration reference value, and also a maximum IPM temperature is 71° C. and thus within a reference temperature. In this case, only drainage RPM may be increased. Therefore, the drainage RPM may be increased by 20 without adding the water in a subsequent operation.

When measurement information 1110 on clothing amount LV 5 is identified, the tub vibration is within 9 mm and thus greater than the vibration reference value, and also the maximum IPM temperature is 74° C. and thus within the reference temperature. In this case, the drainage RPM may be maintained, and the amount to add the water for the dehydration with the remaining water may be increased. Therefore, only 2 liters of the water may be added in a course of the dehydration with the remaining water without changing the drainage RPM in the subsequent operation. Adding the water may be performed through an operation of decreasing drainage by adding the 2 liters to the remaining water which is previously left or an operation of additionally introducing the water.

When measurement information 1115 on clothing amount LV 6 is identified, the tub vibration is within 11 mm and thus greater than the vibration reference value, and also a maximum IPM temperature is 90° C. and thus corresponds to the reference temperature. Therefore, an operation load is required to be reduced while the vibration is also reduced. In this case, the amount to add the water for the dehydration with the remaining water may be increased while the drainage RPM is decreased. Thus, in the subsequent operation, the drainage RPM may be decreased by 30, and 5 liters of the water may be added in the course of the dehydration with the remaining water. Adding the water may be performed through an operation of decreasing the drainage by adding the 5 liters to the remaining water which is previously left or an operation of additionally introducing the water.

As such, evolution in consideration of the vibration value and an IPM temperature value at a same time may be performed. Through this, there may be an effect of preventing an abnormal operation while reducing the tub vibration.

Meanwhile, the present specification and drawings have been described with respect to the example embodiments of the present disclosure. Although specific terms are used, it is only used in a general sense to easily explain the technical content of the present disclosure and to help the understanding of the invention, and is not intended to limit the scope of the specification. It will be apparent to those skilled in the art that other modifications based on the technical spirit of the present disclosure may be implemented in addition to the embodiments disclosed herein.

The invention claimed is:

1. A control method of a clothing treatment device comprising a cabinet forming an exterior, a tub provided in the cabinet and configured to store water, a drum provided to the tub in a rotatable manner and configured to receive clothing, a drainage unit configured to drain the water from the tub, and a driving unit including a motor configured to rotate the drum, the control method comprising:

a clothing amount sensing operation of sensing a weight of the clothing;

a water supply operation of supplying the water to the tub;

a first dehydration operation of maintaining at least a portion of the supplied water and rotating the drum while drainage is stopped; and a second dehydration operation of rotating the drum at a drum rotation speed higher than a maximum drum rotation speed in the first dehydration operation, wherein the drainage is performed in at least a portion of periods after the first dehydration operation, wherein the drainage is performed when the drum rotation speed corresponds to drainage revolutions per minute (RPM), and wherein the drainage RPM is determined based on at least one of a vibration value and a temperature value of a power module that are measured in the first dehydration operation.

2. The control method of claim 1, wherein a maximum drum rotation speed in the second dehydration operation is determined based on a vibration value measured in at least a portion of periods in the second dehydration operation.

3. The control method of claim 1, further comprising, when the weight of the clothing corresponds to a predetermined condition, an additional water supply operation of additionally supplying water after the water supply operation.

4. The control method of claim 3, wherein an amount of the additionally supplied water is determined based on at least one of a vibration value and a temperature value of the power module that are measured in a previously performed washing process corresponding to the sensed weight of the clothing.

5. The control method of claim 1, wherein the drainage RPM is determined based on at least one of a vibration value and a temperature value of the power module that are measured in a previously performed washing process corresponding to the sensed weight of the clothing.

6. The control method of claim 1, further comprising, when the vibration value in the first dehydration operation is greater than or equal to a reference vibration value, a clothing dispersion operation of changing a drum speed.

7. The control method of claim 6, further comprising, when the vibration value in the first dehydration operation is greater than or equal to the reference vibration value, an additional water supply operation of performing additional supply of water based on the temperature value of the power module measured in the first dehydration operation, wherein an amount of the water which is additionally supplied is determined based on the measured temperature value of the power module.

8. The control method of claim 1, further comprising a pre-drainage operation of draining a portion of the water before the first dehydration operation based on at least one of a vibration value and a temperature value of the power module that are measured in a previously performed washing process corresponding to the sensed weight of the clothing.

9. A clothing treatment device comprising:

a cabinet forming an exterior;

a tub provided in the cabinet and configured to store water;

a drum provided to the tub in a rotatable manner and configured to receive clothing;

a drainage unit configured to drain the water from the tub;

a driving unit including a motor configured to rotate the drum; and a controller configured to control the clothing treatment device to perform a clothing amount sensing operation of sensing a weight of the clothing, a water supply operation of supplying the water to the tub, a first dehydration operation of maintaining at least a portion of the supplied water and rotating the drum while drainage is stopped, and a second dehydration operation of rotating the drum at a drum rotation speed higher than a maximum drum rotation speed in the first dehydration operation, wherein the drainage is performed in at least a portion of periods after the first dehydration operation, wherein the drainage is performed when the drum rotation speed corresponds to drainage revolutions per minute (RPM), and wherein the drainage RPM is determined based on at least one of a vibration value and a temperature value of a power module that are measured in the first dehydration operation.

10. The clothing treatment device of claim 9, wherein a maximum drum rotation speed in the second dehydration operation is determined based on a vibration value measured in at least a portion of periods in the second dehydration operation.

11. The clothing treatment device of claim 9, wherein when the weight of the clothing corresponds to a predetermined condition, the controller is configured to control the clothing treatment device to perform an additional water supply operation of additionally supplying water after the water supply operation.

12. The clothing treatment device of claim 11, wherein an amount of the additionally supplied water is determined based on at least one of a vibration value and a temperature value of the power module that are measured in a previously performed washing process corresponding to the sensed weight of the clothing.

13. The clothing treatment device of claim 9, wherein the drainage RPM is determined based on at least one of a vibration value and a temperature value of the power module that are measured in a previously performed washing process corresponding to the sensed weight of the clothing.

14. The clothing treatment device of claim 9, wherein when the vibration value in the first dehydration operation is greater than or equal to a reference vibration value, the controller is configured to control a clothing dispersion operation of changing a drum speed.

15. The clothing treatment device of claim 14, wherein when the vibration value in the first dehydration operation is greater than or equal to the reference vibration value, the controller is configured to control the clothing treatment device to further perform an additional water supply operation of performing additional supply of water based on the temperature value of the power module measured in the first dehydration operation, and wherein an amount of the water which is additionally supplied is determined based on the measured temperature value of the power module.

16. The clothing treatment device of claim 9, wherein the controller is configured to control the clothing treatment device to perform a pre-drainage operation of draining a portion of the water before the first dehydration operation based on at least one of a vibration value and a temperature value of the power module that are measured in a previously performed washing process corresponding to the sensed weight of the clothing.

* * * * *